US009063464B2

(12) United States Patent
Furutani et al.

(10) Patent No.: US 9,063,464 B2
(45) Date of Patent: Jun. 23, 2015

(54) DEVELOPER CONTAINING UNIT, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Masaki Furutani, Tokyo (JP); Koji Yamaguchi, Numazu (JP); Tetsuo Uesugi, Kawasaki (JP); Junichi Matsumura, Numazu (JP); Tomonori Matsunaga, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/909,391

(22) Filed: Jun. 4, 2013

(65) Prior Publication Data

US 2013/0336679 A1 Dec. 19, 2013

(30) Foreign Application Priority Data

Jun. 15, 2012 (JP) ..... 2012-135580
Sep. 11, 2012 (JP) ..... 2012-199740

(51) Int. Cl.
*G03G 15/08* (2006.01)
*G03G 21/18* (2006.01)

(52) U.S. Cl.
CPC ..... *G03G 15/0874* (2013.01); *G03G 21/18* (2013.01)

(58) Field of Classification Search
CPC ..... G03G 15/0832; G03G 15/0839; G03G 2215/0692
USPC ..... 399/258, 261, 263
See application file for complete search history.

(56) References Cited

U.S. PATENT DOCUMENTS

| | | | |
|---|---|---|---|
| 6,681,088 | B2 | 1/2004 | Kanno et al. |
| 6,782,219 | B2 | 8/2004 | Yoshino et al. |
| 6,834,173 | B2 | 12/2004 | Yamaguchi et al. |
| 6,836,639 | B2 | 12/2004 | Karakama et al. |
| 6,915,092 | B2 | 7/2005 | Yamaguchi et al. |
| 6,947,687 | B2 | 9/2005 | Yamaguchi et al. |
| 6,961,528 | B2 | 11/2005 | Yamaguchi et al. |
| 6,983,115 | B2 | 1/2006 | Isobe et al. |
| 7,068,965 | B2 | 6/2006 | Yoshino et al. |
| 7,116,925 | B2 | 10/2006 | Yamaguchi |
| 7,136,604 | B2 | 11/2006 | Chadani et al. |
| 7,184,687 | B2 | 2/2007 | Yamaguchi et al. |
| 7,194,225 | B2 | 3/2007 | Yamaguchi |
| 7,319,834 | B2 | 1/2008 | Yamaguchi |
| 7,477,865 | B2 | 1/2009 | Yamaguchi |
| 7,519,310 | B2 | 4/2009 | Yamaguchi et al. |

(Continued)

FOREIGN PATENT DOCUMENTS

JP 4-66980 H 3/1992

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

A developer containing unit configured to contain a developer, the developer containing unit including: a flexible container configured to contain the developer and provided with an opening portion through which the developer is discharged; a frame configured to accommodate the flexible container; a pressure member provided in the frame and configured to deform the flexible container; and an abutment portion extending in a longitudinal direction of the frame and at which the flexible container and the frame abut against each other.

22 Claims, 34 Drawing Sheets

(56) References Cited

U.S. PATENT DOCUMENTS

| | | | |
|---|---|---|---|
| 7,792,460 | B2 | 9/2010 | Yamaguchi et al. |
| 8,121,519 | B2 | 2/2012 | Yamaguchi et al. |
| 2011/0142487 | A1 | 6/2011 | Anan et al. |
| 2012/0027457 | A1 | 2/2012 | Yamaguchi et al. |
| 2013/0039678 | A1* | 2/2013 | Yoshida et al. ..... 399/262 |
| 2013/0136489 | A1 | 5/2013 | Yamaguchi et al. |
| 2013/0164039 | A1 | 6/2013 | Matsushita et al. |
| 2013/0164040 | A1 | 6/2013 | Matsushita et al. |

* cited by examiner 18
218b
218c
250a
251b
17
16
G
H
H'
H''

DEVELOPER CONTAINING UNIT, PROCESS CARTRIDGE, AND ELECTROPHOTOGRAPHIC IMAGE FORMING APPARATUS

BACKGROUND OF THE INVENTION

1. Field of the Invention

The present invention relates to a developer containing unit configured to contain a developer, a process cartridge including the developer containing unit, and an electrophotographic image forming apparatus including the process cartridge.

The image forming apparatus mentioned herein forms, for example, an image on a recording medium by using an electrophotographic image forming process, which includes, for example, an electrophotographic copy machine, an electrophotographic printer (for example, a light emitting diode (LED) printer and a laser beam printer), and an electrophotographic facsimile machine.

The cartridge is a component including a developing device accommodating at least a developing unit and a developer, which is integrally formed in the component, and configured to be removably mountable to an image forming apparatus main body or a component including a developing device and a photosensitive member unit including at least a photosensitive member, which are integrally formed in the component, and configured to be removably mountable to the image forming apparatus main body.

The developer containing unit is a component which is accommodated in the image forming apparatus or the cartridge. The developer containing unit includes at least a flexible container configured to contain the developer.

2. Description of the Related Art

A conventional electrophotographic image forming apparatus using the electrophotographic image forming process employs a process cartridge system in which an electrophotographic photosensitive member and a corresponding process unit are integrated into a cartridge and this cartridge is removably mountable to a main body of the electrophotographic image forming apparatus.

In such a process cartridge, the following system is widely employed. As illustrated in FIG. 20, an opening portion of a developer containing frame 31 that contains a developer (toner, carrier) is sealed with a sealing member. When using the process cartridge, a junctional portion 33 of a toner seal 32 that serves as the sealing member is pulled away to open the opening portion so that the developer can be supplied (see Japanese Patent Application Laid-Open No. H04-66980).

Further, to cope with a problem in that the developer is scattered in the process cartridge in a process of filling the developer when manufacturing the process cartridge, a technology using a deformable inner container has been proposed (see Japanese Patent Application Laid-Open No. H04-66980).

In this manner, in Japanese Patent Application Laid-Open No. H04-66980, a method of containing the developer in a deformable inner container is described for the purpose of increasing an operability in supplying the developer and reducing the cost of the developer supplying device by preventing the developer from being scattered in the device. However, Japanese Patent Application Laid-Open No. H04-66980 does not describe an operation and a mechanism regarding discharge of the developer after unsealing the deformable developer containing member (flexible container).

SUMMARY OF THE INVENTION

The present invention has been made in view of the above-mentioned circumstances, and the present invention provides a developer containing unit configured to suppress a phenomenon that a developer discharged from an opening portion of a flexible container enters a gap between the flexible container and a frame so that the developer is used in developing without waste.

According to an exemplary embodiment of the present invention, there is provided a developer containing unit configured to contain a developer, the developer containing unit including: a flexible container configured to contain the developer and provided with an opening portion through which the developer is discharged; a frame configured to accommodate the flexible container; a pressure member provided in the frame and configured to deform the flexible container; and an abutment portion extending in a longitudinal direction of the frame and at which the flexible container and the frame abut against each other.

According to another exemplary embodiment of the present invention there is provided a developer containing unit including: a flexible container configured to contain a developer and provided with an opening portion through which the developer is discharged; a frame configured to accommodate the flexible container and to accommodate the developer discharged from the flexible container; and a fixing portion configured to hold the flexible container in the frame, wherein the opening portion opens vertically downwardly, an abutment portion is provided in a position in which the abutment portion abuts or is allowed to abut against the flexible container, and the abutment portion is disposed vertically above the opening portion.

Further features of the present invention will become apparent from the following description of exemplary embodiments with reference to the attached drawings.

DESCRIPTION OF THE EMBODIMENTS

Outline of Configuration of Image Forming Apparatus

Figure 2:
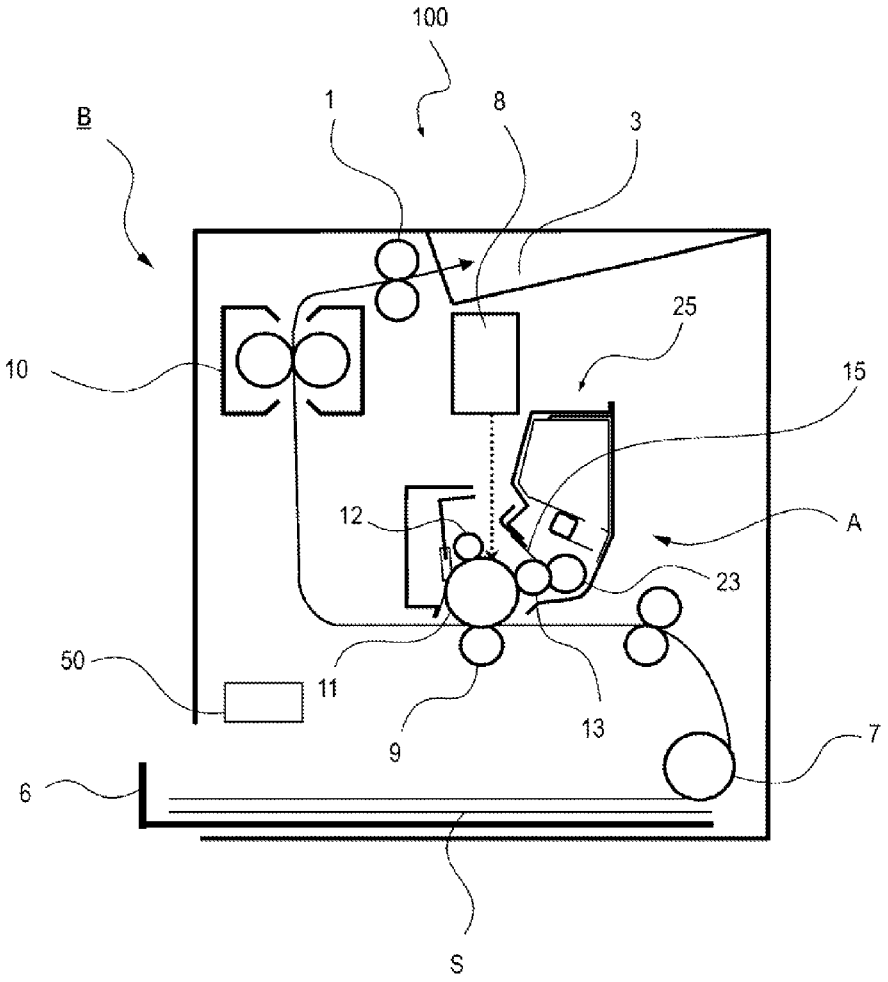
FIG. 2 is a cross-sectional view illustrating a configuration of an image forming apparatus.

FIG. 2 is a cross-sectional view illustrating a configuration of an image forming apparatus 100. As illustrated in FIG. 2, the image forming apparatus 100 which is an "electrophotographic image forming apparatus" includes an apparatus main body B which is an "image forming apparatus main body" having a configuration in which a cartridge A which is a "process cartridge" is removably mountable to the apparatus main body B. The cartridge A includes a photosensitive drum 11 and a developer containing unit 25 integrally provided therein. A sheet cassette 6 mounted in the lower portion of the apparatus main body B stores sheets S. At the time of forming an image, the sheet S is conveyed by a conveying roller 7 to the photosensitive drum 11 serving as an "electrophotographic photosensitive drum" which is an "image bearing member."

In synchronization with this operation, the surface of the photosensitive drum 11 is uniformly charged by a charging roller 12 and exposed by an exposing device 8 so that an electrostatic image is formed on the surface. The cartridge A contains a developer and includes a developing roller 13 which is a developer carrying member. The developer is supplied to the developing roller 13 by a supplying roller 23 and carried on the surface of the developing roller 13 in a thin layer achieved by a developing blade 15. When a developing bias is applied to the developing roller 13, the above-mentioned electrostatic image is developed with the developer so that a developer image is formed on the surface of the photosensitive drum 11.

The developer image is transferred onto the conveyed sheet S by a transfer roller 9 to which a bias voltage is applied. The sheet S is then conveyed to a fixing device 10 where the image is fixed and discharged to a discharging unit 3 by a discharge roller 1. The apparatus main body B includes a controller 50 that controls a driving of an internal device of the apparatus main body B. As will be described later, the controller 50 further controls a pressure sheet 21 (see FIG. 1) in such a manner that the pressure sheet 21 is rotated to repeatedly press a flexible container 16 (see FIG. 1).

Outline of Configuration of Process Cartridge

Figure 1:
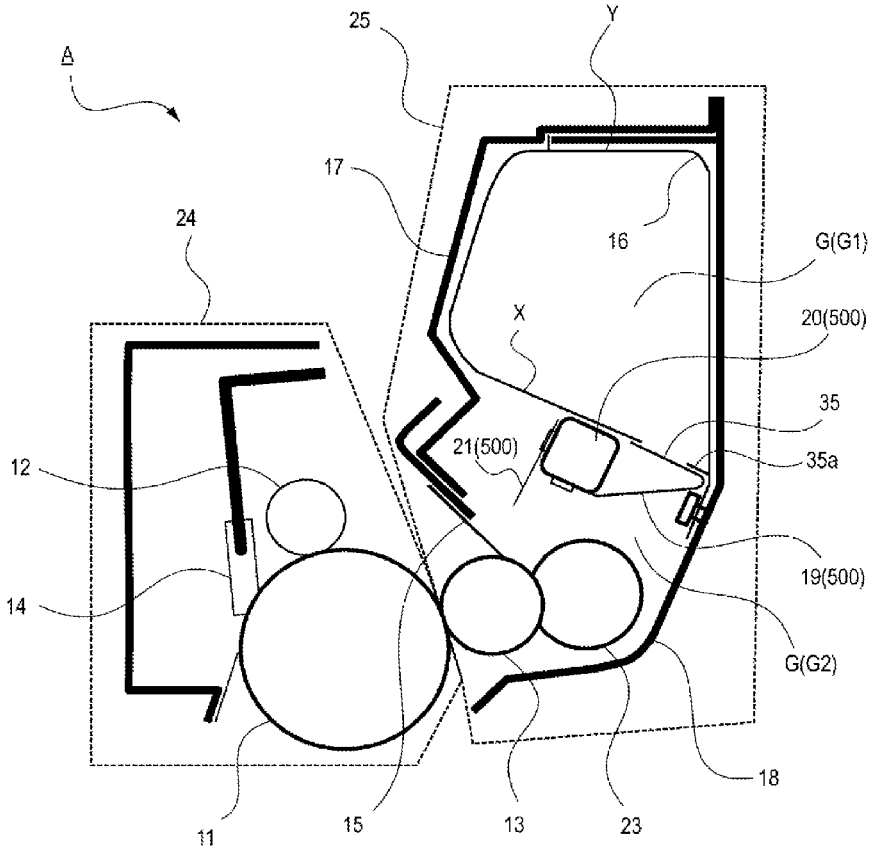
FIG. 1 is a cross-sectional view illustrating a configuration of a developer containing unit.

FIG. 1 is a cross-sectional view illustrating a configuration of the cartridge A. As illustrated in FIG. 1, the cartridge A includes a cleaning unit 24 as well as the developer containing unit 25. The cleaning unit 24 includes the photosensitive drum 11, a cleaning blade 14 that cleans the surface of the photosensitive drum 11, and the charging roller 12 that charges the surface of the photosensitive drum 11. The developer containing unit 25 includes the developing roller 13, the supplying roller 23 that supplies the developer to the developing roller 13, and the flexible container 16 that contains the developer. The developer containing unit 25 is further described in detail below.

The developer containing unit 25 includes a frame 17 which is a "first frame" and a frame 18 which is a "second frame." The flexible container 16 and a pressure member 500 (pressure body, pressure unit) are arranged in an upper side region of the frames 17 and 18. As will be described later, the pressure member 500 includes the pressure sheet 21, a sealing member 19, and a rotating member 20. However, the present invention has its feature in the flexible container 16. The flexible container 16 is a container that includes an opening portion 35*a* configured to discharge a developer G (G1) and contains the developer G (G1). The developing roller 13 and the supplying roller 23 are arranged in a lower side region of the frames 17 and 18. With this configuration, a developer G (G2) having been discharged from the flexible container 16 is accommodated in the lower side region of the frames 17 and 18, while the flexible container 16 containing the developer is accommodated in the tipper side region of the frames 17 and 18.

The pressure member 500 is arranged to face the bottom surface of the flexible container 16. The pressure sheet 21 and a part of the sealing member 19 are fixed on the rotating member 20 of the pressure member 500. The sealing member 19 is a member that seals the opening portion 35*a*, and after breaking the seal by rotation of the rotating member, presses the flexible container 16. The pressure sheet 21 deforms the flexible container 16 by pressing the bottom surface of the flexible container 16 when the sealing member 19 opens the opening portion 35*a* or after the sealing member 19 opens the opening portion 35*a*. In the region where the flexible container 16 is arranged in the frames 17 and 18, the flexible container 16 and the frames 17 and 18 that face each other are brought into abutment against each other. A mechanism configured to bring these portions into abutment against each other will be described in detail in the first to the fifth embodiments of the present invention.

In this manner, a phenomenon that the developer G2 which is discharged from the opening portion 35*a* of the flexible container 16 and then accommodated in the frames 17 and 18 enters the gap between the flexible container 16 and each of the frames 17 and 18 can be suppressed, and hence the developer G2 is used in the developing without waste. The developing roller 13 and the developing blade 15 are supported by the frame 17.

Outline of Configuration of Developer Containing Unit

Figure 3:
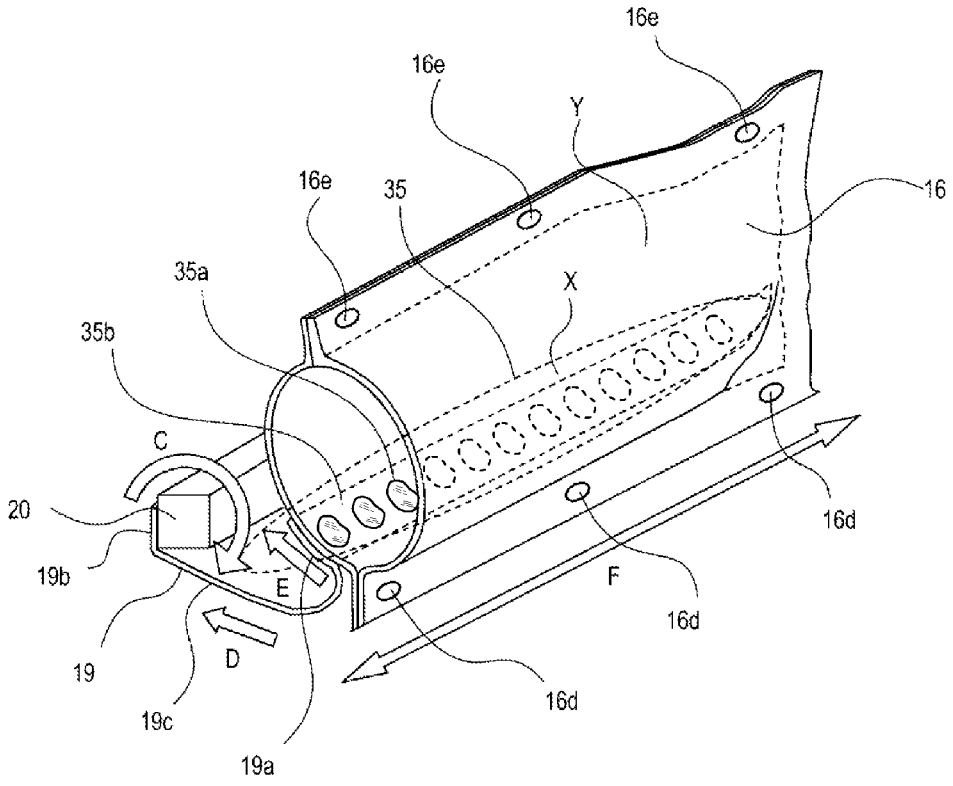
FIG. 3 is a perspective view illustrating a configuration of a flexible container.
Figure 4B:
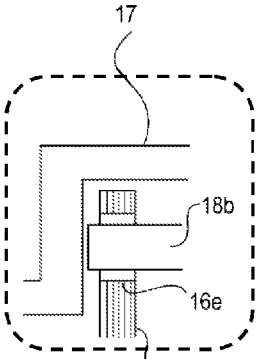
FIGS. 4A, 4B, and 4C are cross-sectional views illustrating an internal configuration of a frame.
Figure 4A:
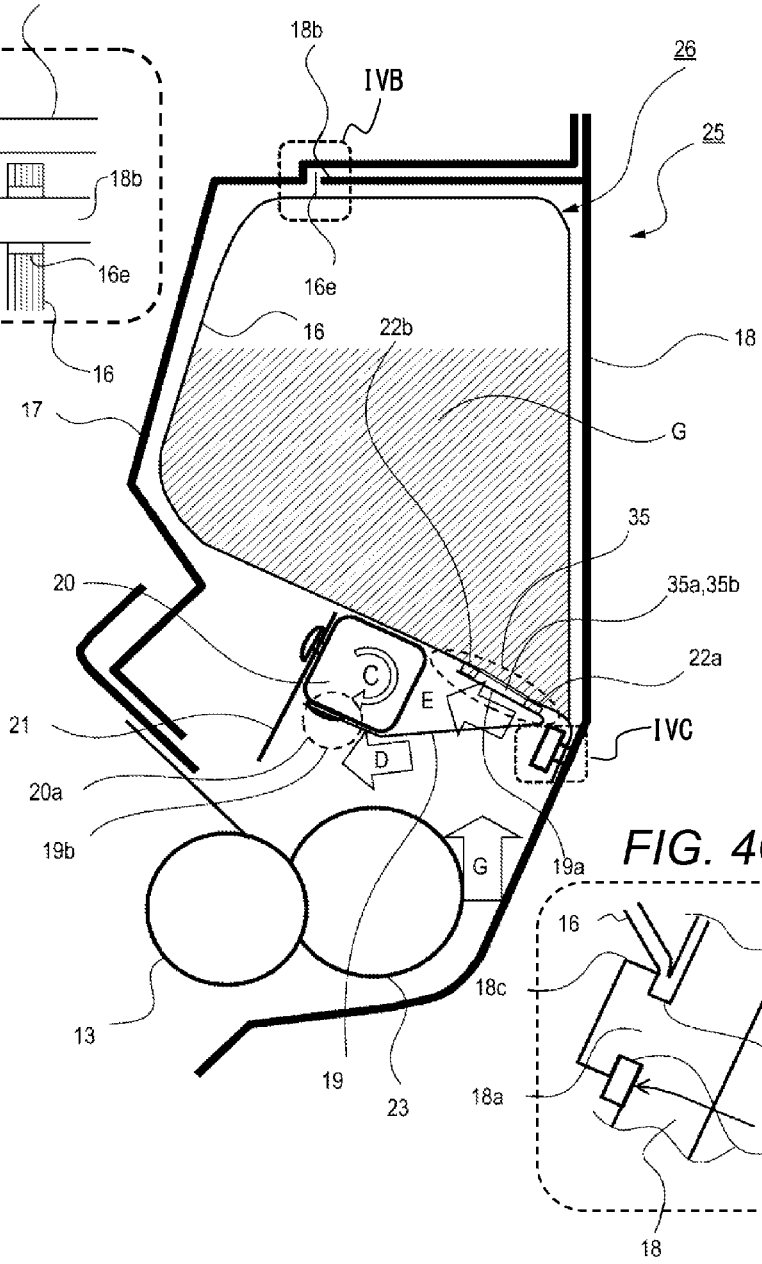
Figure 4C:
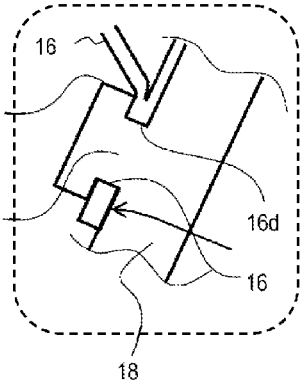
Figure 6:
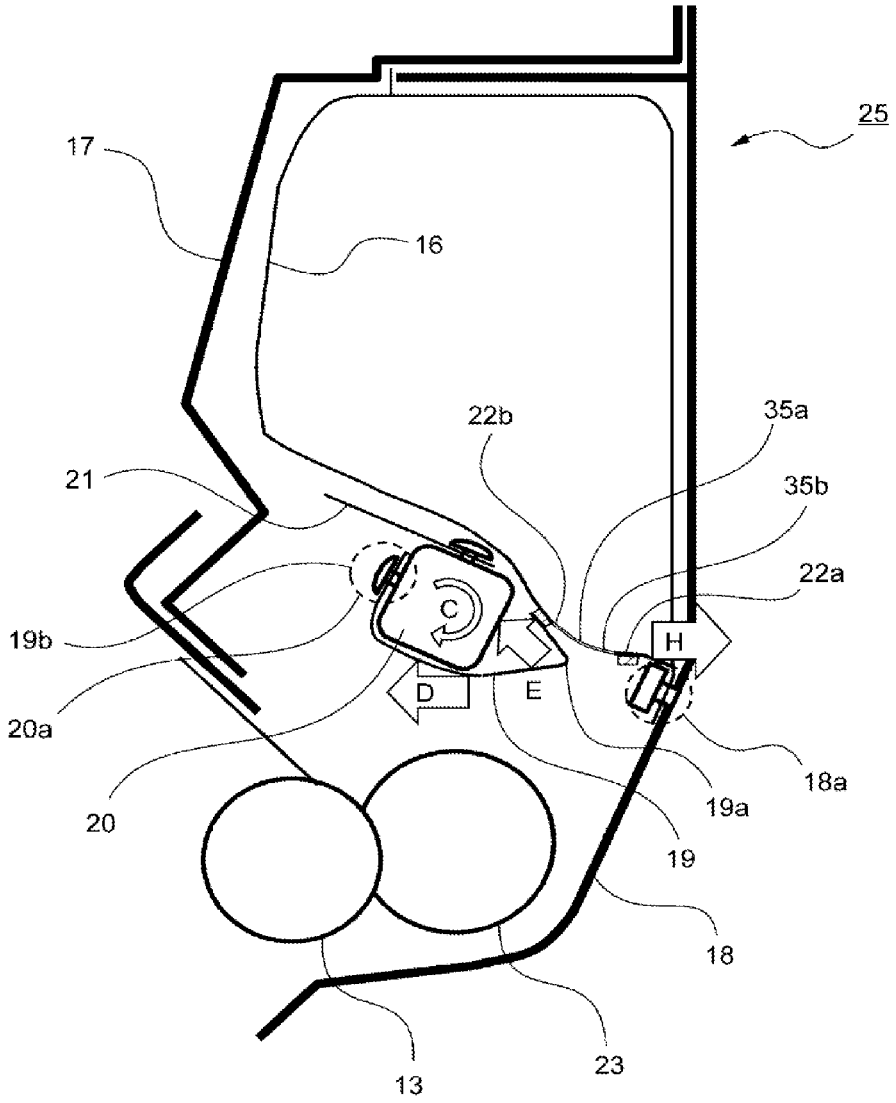
FIG. 6 is a cross-sectional view illustrating an operation inside the frame.

FIG. 3 is a perspective view illustrating an internal mechanism of the frames 17 and 18 obtained by cutting the internal mechanism. FIG. 4A is a cross-sectional view illustrating a configuration of the developer containing unit 25, which illustrates a state in which a sealing portion 19*a* of the sealing member 19 seals the opening portion 35*a*. FIG. 4B is an enlarged diagram of a portion IVB enclosed by a dotted line in FIG. 4A. FIG. 4C is an enlarged diagram of a portion IVC enclosed by a dotted line in FIG. 4A. FIG. 6 is a cross-sectional view illustrating the configuration of the developer containing unit 25, which illustrates a state in which the sealing portion 19*a* of the sealing member 19 opens the opening portion 35*a*.

As illustrated in FIG. 3, a fixing portion 16*e* configured to fix the flexible container 16 to the frames 17 and 18 is formed on the upper portion of the flexible container 16, and a fixing portion 16*d* configured to fix the flexible container 16 to the frame 18 is formed on the bottom portion of the flexible container 16. A discharging portion 35 extending in a longitudinal direction of the flexible container 16 is formed on a part of the surface of the flexible container 16. The discharging portion 35 includes a connecting portion 35*b* that defines (shapes) the opening portion 35*a* through which the developer is discharged. The surface including the discharging portion 35 is herein referred to as "opening portion including surface X" because the surface is provided with the opening portion 35*a*, and the other portion of the surface is herein referred to as "other surface Y."

The rotating member 20 is arranged at a position feeing the surface of the flexible container 16. The rotating member 20 is a member that rotates about an axis. A base end portion of the sealing member 19 is fixed to the rotating member 20. Specifically, the configuration is as follows. The sealing member 19 includes an engaging portion 19*b*, a connecting portion 19*c*, and the sealing portion 19*a*. The engaging portion 19*b* is fixed to the rotating member 20, and the sealing portion 19*a* is fixed to the discharging portion 35. When the rotating member 20 rotates in a direction indicated by an arrow C, the seating portion 19*a* opens the opening portion 35*a*. The sealing member 19 is configured so that the engaging portion 19*b* is fixed to the rotating member 20 by a fastening member (see FIG. 4A), and the leading end portion thereof is fixed to the discharging portion 35 to cover the opening portion 35*a*.

As illustrated in FIG. 4A, the pressure sheet 21 is fixed to the rotating member 20. When the rotating member 20 rotates, the pressure sheet 21 presses the flexible container 16 or releases the pressing while rotating. The base end portion of the pressure sheet 21 is fastened to the rotating member 20 by the fastening member. The fixing portion 16*e* of the flexible container 16 is fixed to a fixing portion 18*b* of the frame 18. The fixing portion 16*d* of the flexible container 16 is fixed to a fixing portion 18*a* of the frame 18. In this manner, the flexible container 16 is supported in the frames 17 and 18.

As illustrated in FIG. 6, when the rotating member 20 rotates, the sealing portion 19*a* of the sealing member 19 is gradually pulled away from the opening portion 35*a*. At the same time, the pressure sheet 21 approaches the flexible container 16 to press the flexible container 16.

Flexible Container Containing Developer

Figure 14A:
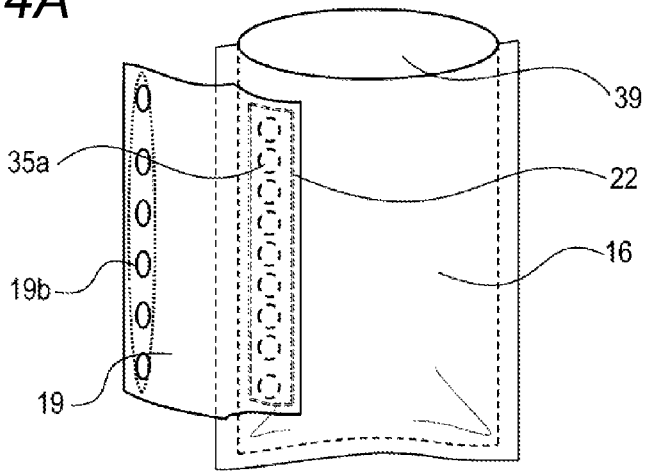
FIGS. 14A, 14B, and 14C are side views illustrating the configuration of the flexible container.
Figure 14B:
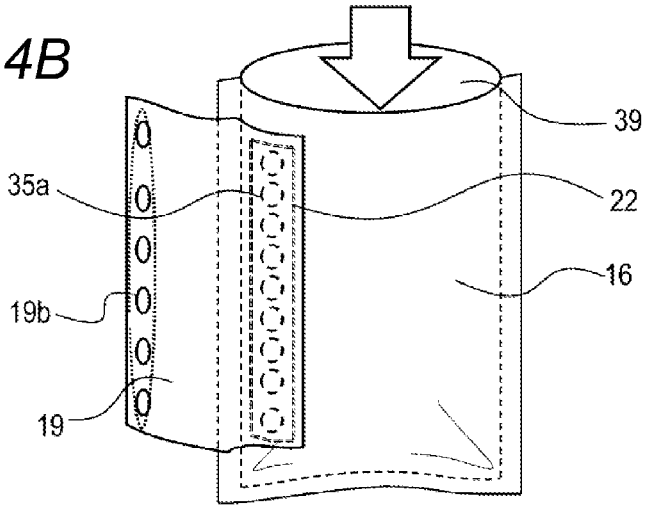
Figure 14C:
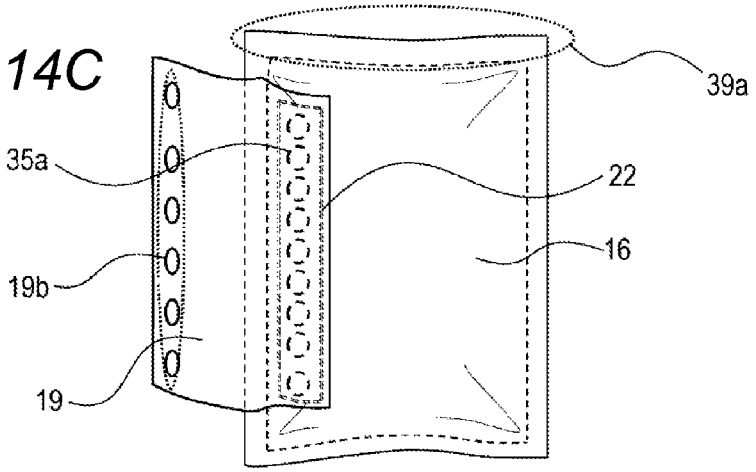

FIGS. 14A, 14B, and 14C are perspective views illustrating the configuration of the flexible container 16. As illustrated in FIG. 14A, the flexible container 16 includes a tilling port 39 through which the developer is filled at one end portion in the longitudinal direction. The flexible container 16 further includes a plurality of opening portions 35*a* arranged in a row (may be arranged in a plurality of rows) in the longitudinal direction on the surface of the flexible container 16 The sealing member 19 adheres on the opening portions 35*a* of the flexible container 16. In this manner, the end portion of the sealing member 19 adheres to seal the opening portions 35*a* of the flexible container 16, and a hole, which is the engaging portion 19*b* which is engaged with the fastening member of the rotating member 20, is formed in the base end portion of the sealing member 19. The developer is a powder in this case. In the state illustrated in FIG. 14A, the developer is not filled in the flexible container 16, and the filling port 39 is unsealed.

As illustrated in FIG. 14B, the developer is filled in the flexible container 16 through the filling port 39 in a direction indicated by an arrow, and hence the inside of the flexible container 16 is filled with the developer. A shape of the filling port 39 can be changed in accordance with a filling device due to the flexibility of the flexible container 16, and hence the developer can be easily filled without being scattered away. Although the filling of the developer is performed by using a known auger-type tilling device, other methods having a similar function can also be used.

As illustrated in FIG. 14C, when the developer is filled, the flexible container 16 is bonded at a junctional portion 39*a*. The opening portions 35*a* and the filling port 39 of the flexible container 16 in which the developer is filled in the above-mentioned manner are sealed, and hence the flexible container 16 containing the developer can be handled as a single unit without leakage of the contained developer. Although the junctional portion 39*a* of the filling port 39 is welded by using an ultrasonic wave in the embodiment, heat, laser, or the like can also be used to join the junctional portion 39*a*. A position and a size of the filling port 39 can be appropriately determined in accordance with the developer filling device or a shape of the cartridge A.

Effect of Providing Flexible Container in Frame

The developer can be handled as a unit by the flexible container 16 containing the developer having a baggy shape. Therefore, the developer filling process can be performed separately from a main assembling process (manufacturing line) of the cartridge A. This eliminates scattering of the developer in the main assembling process (manufacturing line) of the cartridge A, enabling reduction of maintenance such as cleaning of the manufacturing line. By eliminating the scattering of the developer in the assembling process, the cleaning process of the cartridge A after filling the developer can be omitted.

In the filling process of the flexible container 16 as well, because the flexible container 16 has flexibility and the filling port 39 is also soft, the scattering is reduced, and hence the flexible container 16 can be easily sealed. Further, because the flexible container 16 containing the developer has the flexibility, the flexible container 16 can be assembled to fit on a shape of the frame.

In addition, because the flexible container 16 has the flexibility in the filling process, the developer can be filled by deforming a cross section of the flexible container 16 to increase a volume, and hence a filling amount can be increased when filling the developer. Moreover because the flexible container 16 before filling the developer has the flexibility, the flexible container 16 can be pressed to a small (thin) volume, and hence a space for storing the flexible container 16 before filling the developer can be saved compared to that for a frame which is a resin structure.

Configuration of Flexible Container

As illustrated in FIGS. 3 and 4A, the flexible container 16 contains the developer therein and has a baggy shape that can be deformed, and the discharging portion 35 includes the plurality of opening portions 35*a* through which the contained developer is discharged. The flexible container 16 further includes the flexible container fixing portions (portion to be fixed) 16*d* and 16*e* configured to be fixed to the frames 17 and 18.

Material and Breathability of Flexible Container

Figure 13A:
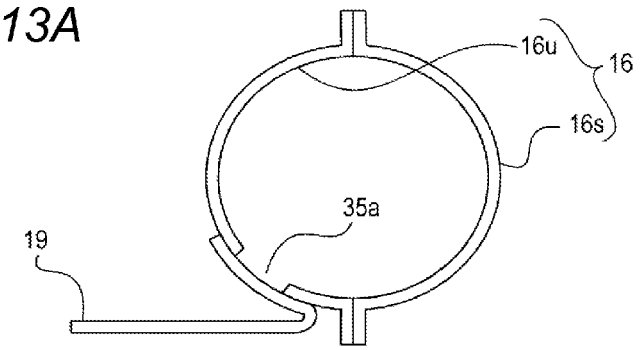
FIGS. 13A, 13B, and 13C are cross-sectional views illustrating a configuration of the flexible container.
Figure 13B:
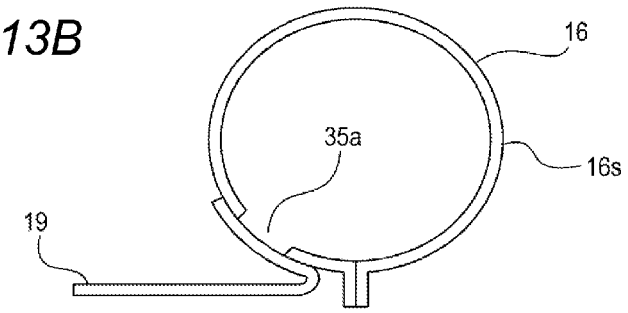
Figure 13C:
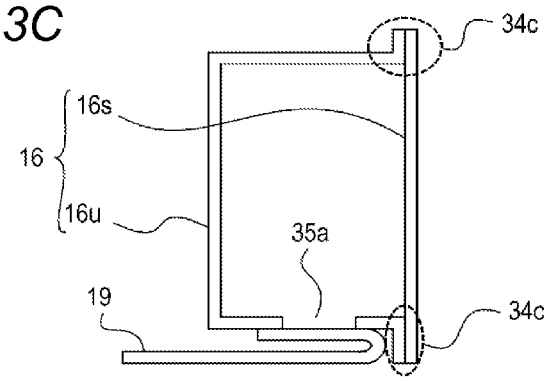

FIGS. 13A, 13B, and 13C are cross-sectional explanatory diagrams of the flexible container 16. As illustrated in FIG. 13A, the flexible container 16 is formed by joining together a sheet 16*u* that includes the discharging portion 35 and does not have breathability and a breathable sheet 16*s* which is a breathable portion and has breathability. The breathability of the sheet 16*s* can be appropriately selected so that the developer is not leaked from the flexible container 16, considering a size of the developer (particle size of the powder) to be contained.

A material of the sheet 16*s* may preferably include polyethylene terephthalate (PET), polyethylene (PE), and polypropylene (PP), which is a non-woven fabric or the like having a thickness of 0.03 mm to 0.15 mm. Instead of the non-woven fabric, the material of the sheer 16*s* can be any material having a micro hole smaller than the powder such as the developer to be contained in the flexible container 16.

In the embodiment, the sheet 16*s* is arranged across the whole region of the flexible container 16 in the longitudinal direction on the side of the frame 18, as illustrated in FIGS. 3, 13A, 13B, and 13C. Further, as illustrated in FIG. 13B, the sheet 16*s* may constitute the whole of the flexible container 16. As a material of the flexible container 16 other than the sheet 16*s*, a material having the flexibility is preferred to increase the efficiency at the time of discharging the developer, which will be described later. The material of the sheet 16*s* may also have the flexibility.

Configuration of Discharging Portion of Flexible Container

Figure 10:
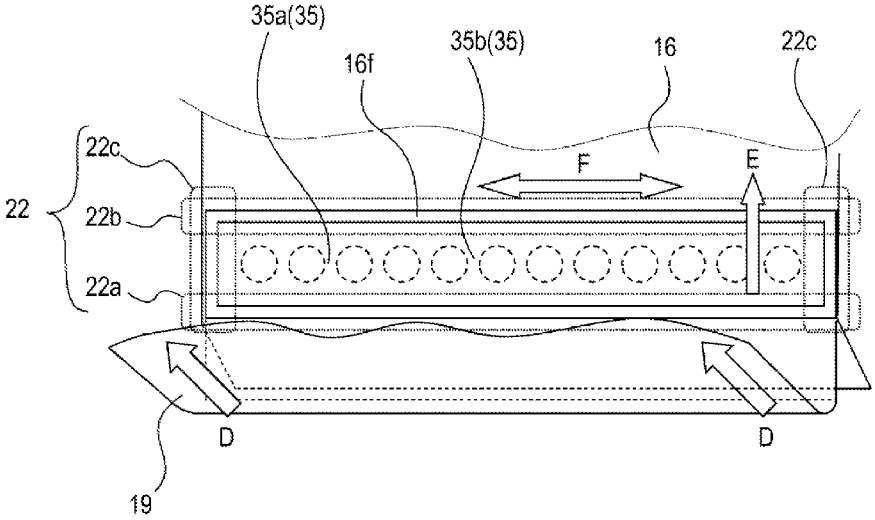
FIG. 10 is a plan view illustrating a configuration of a discharging portion.

As illustrated in FIG. 10, the flexible container 16 includes the discharging portion 35. The discharging portion 35 includes the opening portion 35*a* and the connecting portion 35*b*. The opening portion 35*a* is an opening through which the developer in the flexible container 16 is discharged, and the discharging portion 35 of the flexible container 16 includes the plurality of opening portions 35*a*. The connecting portion 35*b* corresponds to an outer shape of the flexible container 16 which connects between the plurality of opening portions 35*a*. The sealing member 19 is openably joined or bonded to the discharging portion 35 at a junctional portion 22 continuously surrounding the discharging portion 35 so that the developer contained in the flexible container 16 can be sealed.

Configuration of Junctional Portion of Flexible Container

The junctional portion 22 includes two junctional portions in a longer direction (direction indicated by an arrow F) and two junctional portions in a shorter direction (direction indicated by an arrow E) surrounding continuously in a rectangular shape, thus enabling the sealing of the discharging portion 35.

One junctional portion which is separated first among the two junctional portions welded in the longer direction (direction indicated by the arrow F) is referred to as "first junctional portion 22*a*," and the other junctional portion which is separated later is referred to as "second junctional portion 22*b*." In the embodiment, when viewed along the surface of the sealing member 19, a junctional portion closer to a turn-back portion 19*d* which will be described later (see FIG. 12) (or the engaging portion 19*b*) is the first junctional portion 22*a*. A junctional portion facing the first junctional portion 22*a* across the opening portion 35*a* is the second junctional portion 22*b*. The junctional portion in the shorter direction is referred to as "short-side junctional portion 22*c*."

In the embodiment, the unsealing direction is the direction indicated by the arrow E. The unsealing direction is defined as follows. When taking off the sealing member 19 by moving the sealing member 19, the first junctional portion 22*a* is unsealed (separated) first between the first junctional portion 22*a* and the second junctional portion 22*b* sandwiching the opening portion 35*a*. In this manner, a direction from the first junctional portion 22*a* which is separated first toward the second junctional portion 22*b* is defined as the unsealing direction (direction indicated by the arrow E).

When taking off (separating; the sealing member 19 from the flexible container 16 in the direction indicated by the arrow E, the separating may be advanced also in the direction indicated by the arrow F due to deformation of the flexible container 16 by the unsealing force even in the first junctional portion 22*a* and the second junctional portion 22*b* from a microscopic view. However, the unsealing direction in the embodiment does not mean such a microscopic unsealing direction.

Fixation of Flexible Container and Frame

A description will be provided with reference to FIGS. 3, 4A, 4B, and 4C again. As illustrated in FIGS. 3 and 4A to 4C, the flexible container 16 is feed in the frames 17 and 18 by the two fixing portions 16*d* and 16*e*.

First Fixing Portion

As a first fixing portion, the first fixing portion 16*d* of the flexible container 16 is provided, which receives a force when taking off the sealing member 19 from the flexible container 16 and which will be described later. A plurality of fixing portions 16*d* are provided in parallel to the direction indicated by the arrow F along which the plurality of opening portions 35*a* are arranged. Instead of the plurality of fixing portions 16*d* provided in the above-mentioned, a single fixing portion 16*d* which is elongated in parallel to the direction indicated by the arrow F may be provided (not shown). The first fixing portion 16*d* is provided near the opening portion 35*a* of the flexible container 16. The first fixing portion 16*d* of the flexible container 16 is fixed to a first fixing portion 18*a* of the frame 18. The first fixing portion 16*d* is a fixing place required when unsealing the flexible container 16, and its operation and arrangement will be described in the description of the unsealing.

Second Fixing Portion

As a second fixing portion, the second fixing portion 16*e* is provided, for preventing the flexible container 16 from moving in the downward direction or toward the developing roller 13 and the supplying roller 23. The second fixing portion 16*e* is provided for two reasons. The first reason is to prevent the flexible container 16 from moving in the downward direction with an attitude at the time of forming an image by the second fixing portion 16*e* of the flexible container 16. Therefore, it is preferred that the second fixing portion 16*e* be arranged at the upper side when the flexible container 16 has the attitude at the time of forming an image.

The second reason is to prevent the flexible container 16 from disturbing an image by touching the developing roller 13 or the supplying roller 23 at the time of forming an image. Therefore, it is preferred that the second fixing portion 16*e* of the flexible container 16 be arranged at a position away from the developing roller 13 and the supplying roller 23. In the embodiment, as illustrated in FIG. 4A, the second fixing portion 16*e* of the flexible container 16 is arranged at the upper side away from the developing roller 13. The second fixing portion 16*e* of the flexible container 16 is fixed to the second fixing portion 18*b* of the frame 18.

When fixing the flexible container 16 to the frame 18, the first fixing portion 18*a* of the frame 18 is extended into the first fixing portion 16*d* of the flexible container 16, and the first fixing portion 18*a* of the frame 18 is melted and fixed by using an ultrasonic staking tool.

Configuration of Sealing Member

As illustrated in FIGS. 3 and 4A, the sealing member 19 seals the developer in the flexible container 16 by covering the discharging portion 35 of the flexible container 16 before using the cartridge A. The sealing member 19 is moved to expose the opening portion 35*a*. The sealing member 19 is configured in a sheet shape including the sealing portion 19*a* that covers the discharging portion 35 of The flexible container 16. the engaging portion 19*b* which is fixed to the rotating member 20, which will be described later, and the connecting portion 19*c* which connects the sealing portion 19*a* and the engaging portion 19*b*. The sheet is a laminated material including a sealant layer having an easy-to-open property, which will be described later, with a base material appropriately selected from polyethylene terephthalate (PET), polyethylene, and polypropylene having a thickness of 0.03 mm to 0.15 mm.

Sealing Portion of Sealing Member

The sealing portion 19*a* indicates a region is which the sealing member 19 seals the plurality of opening portions 35*a* and the connecting portion 35*b* of the flexible container 16. The sealing portion 19*a* is configured to prevent the developer from being leaked from the flexible container 16 until the cartridge A is used.

Engaging Portion of Sealing Member

The sealing member 19 includes a free end portion at one end of the unsealing direction (direction indicated by the arrow E). and the engaging portion 19*b* which is engaged with an unsealing member for moving the sealing member 19 is provided at the free end portion.

The engaging portion 19*b* at the end portion of the sealing member 19 for exposing the opening portion 35*a* is engaged with the rotating member 20. The sealing member 19 may automatically perform the unsealing operation by receiving a driving force from the apparatus main body B. Alternatively, the sealing member 19 may perform the unsealing operation by a user holding and moving the seal nig member 19. In the embodiment, the rotating member 20 is a rotating shaft provided on the frame, and the flexible container 16 containing the developer is unsealed by pulling the sealing member 19 engaged with the rotating member 20.

Connecting Portion of Sealing Member

A portion which connects between the junctional portion 22 and the engaging portion 19*b* is the connecting portion 19*c* (see FIG. 3). The connecting portion 19*c* is a portion which receives a force from the rotating member 20 and transfers the force to pull and take off the junctional portion 22 (22*a* and 22*b*).

Turning back Connecting Portion

Figure 12:
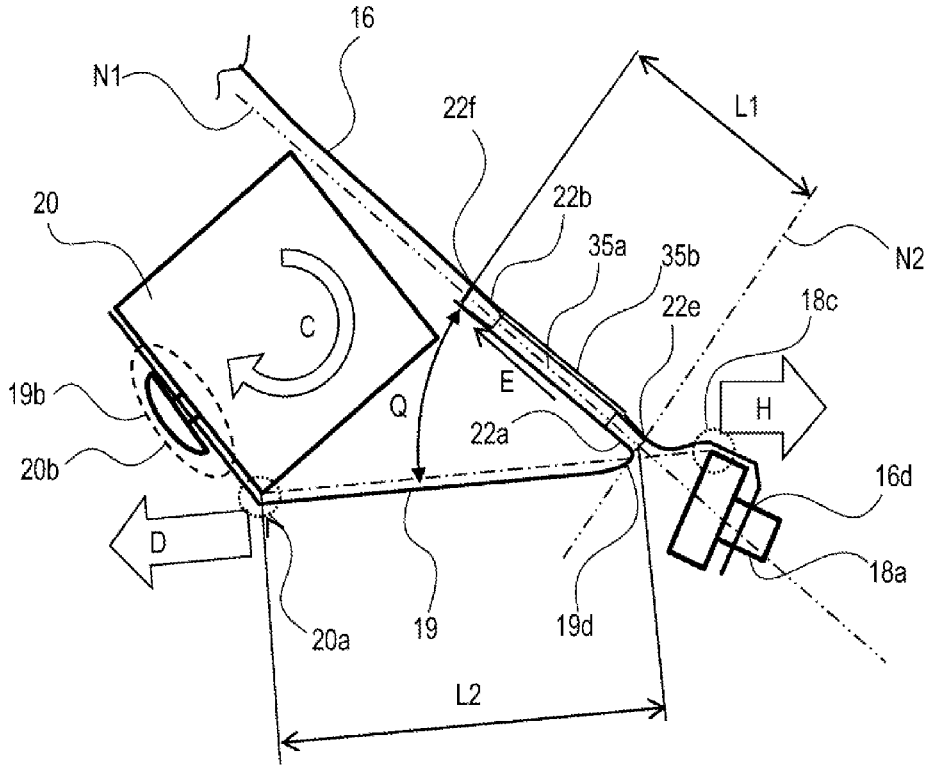
FIG. 12 is a cross-sectional view illustrating a dimensional relationship of the sealing member.

A plane formed by the first junctional portion 22*a* and the second junctional portion 22*b* at the moment when the flexible container 16 is unsealed is defined as a plane N1, as illustrated in FIG. 12. A plane which is perpendicular to the plane N1 and passing through the first junctional portion 22*a* is defined as a plane N2. The rotating member 20 is arranged closer to the second junctional portion 22*b* than the plane N2 that passes through the first junctional portion 22*a*. In other words, when viewed along the surface of the sealing member 19 which is formed in a sheet shape, the sealing member 19 includes a turn-back portion 19*d* which is turned back at a portion (connecting portion 19*c*) between the junctional portion 22 and the engaging portion 19*b* with respect to the rotating member 20. The turn-back portion 19*d* may or may not include a crease. It is preferred that a turn-back angle Q be equal to or smaller than 90 degrees. The turn-back angle Q is an angle between a plane of the junctional portion 22 of the flexible container 16 and a plane along a direction indicated by an arrow D along which the sealing member 19 is pulled.

Fixation of Sealing Member

In the embodiment, the sealing member 19 and the rotating member 20 are fixed by the ultrasonic staking in the same manner as the first fixing member 16*d*. Instead of the ultrasonic staking, in the same manner as the first fixing portion 16*d* and the second fixing portion 16*e*, a thermal welding, an ultrasonic welding, an adhesive bonding, a fitting between the frames, or a hooking by a hole and a protruded portion may be used.

Configuration of Unsealing Member

The rotating member 20 is provided to apply a force on the sealing member 19 to move and take off the sealing member 19 from the flexible container 16. The rotating member 20 includes a support portion (not shown) which has a shaft shape with both ends rotatably supported by the frame 18 and an engaging portion 20*b* to which the engaging portion 19*b* of the sealing member 19 is fixed. In the embodiment, the rotating member 20 has a rectangular shaft shape, and the engaging portion 19*b* of the sealing member 19 is engaged with the engaging portion 20*b* on one surface of the rectangular shaft.

Serving as Unsealing Member, Pressure Member, and Agitating Member

Although the pressure sheet 21 and the rotating member 20 which act from the outside of the flexible container 16 to discharge the developer from the flexible container 16 may be provided as separate members from each other, the same component functions as both the rotating member 20 and the pressure sheet 21 in the embodiment. Further, although the function of agitating the developer discharged from the flexible container 16 and the function of the rotating member 20 may be respectively performed by separate components, the function of the rotating member 20 and the agitating function are performed by the same component in the embodiment.

Effect of Serving as Unsealing Member, Pressure Member, and Agitating Member

In this manner, the same component serves as the rotating member 20, the pressure sheet 21, and the agitating member, and hence cost reduction and space saving can be achieved by reduction of the number of components.

Outline of Unsealing of Flexible Container

The unsealing of the flexible container 16 will be described below with reference to FIGS. 8A, 8B, 7A, 7B, and 7C. The flexible container 16 includes a force acting portion 20*a* where the rotating member 20 applies a force to pull the sealing member 19 to take off the sealing member 19 and the fixing portion 18*a* of the frame 18, configured to fix the flexible container 16 which is pulled accordingly.

Figure 7A:
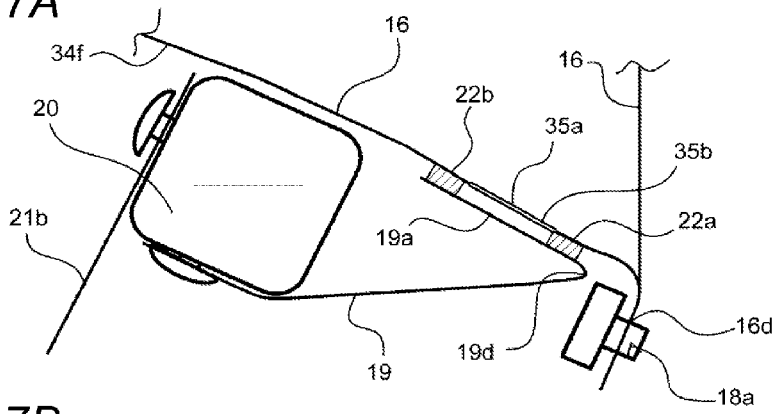
FIGS. 7A, 7B, and 7C are cross-sectional views illustrating an operation of a scaling member.
Figure 7B:
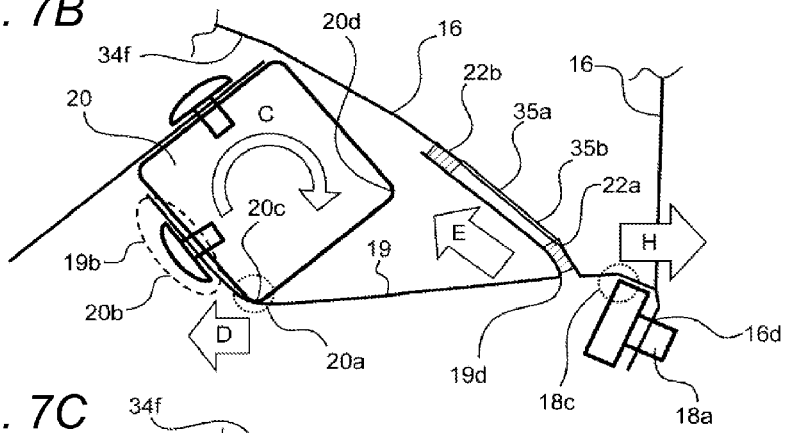
Figure 7C:
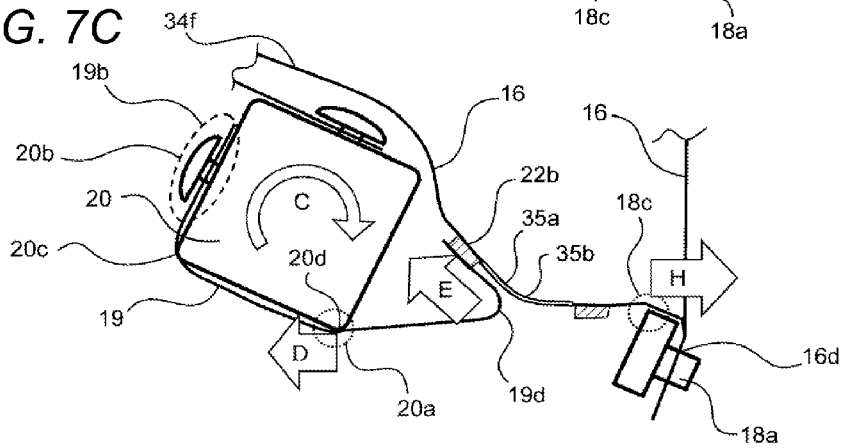
Figure 8A:
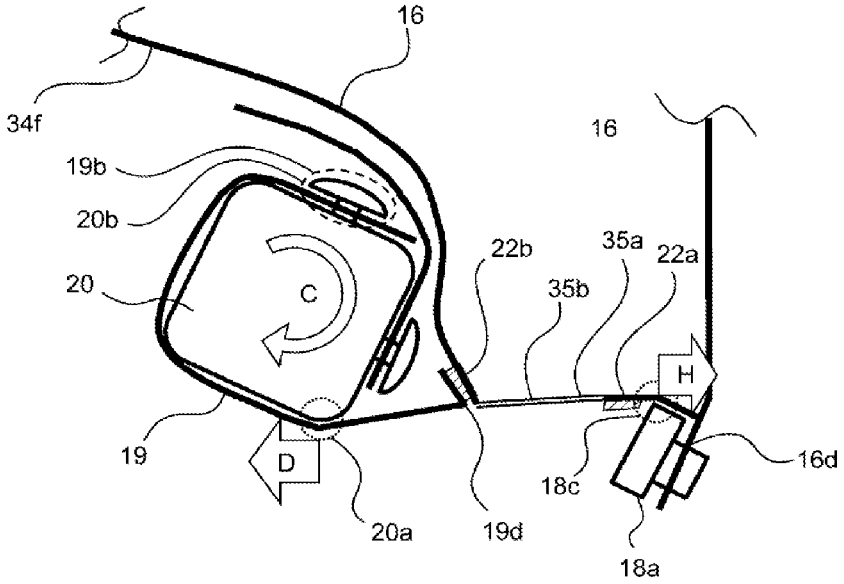
FIGS. 8A and 8B are cross-sectional views further illustrating the operation of the sealing member.

The force acting portion 20*a* is a portion closest to the junctional portion 22 of a portion where the sealing member 19 and the rotating member 20 are brought into contact with each other at the time of unsealing. In FIG. 7B, a corner portion 20*c* of the rotating member 20 is the force acting portion 20*a*. Further, the fixing portion 18*a* of the frame 18 includes a fixing portion 18*c* which suppresses movement of the flexible container 16 due to the force acting at the time of unsealing. In addition, in the embodiment, the first fixing portion 18*a* of the frame 18 and the first fixing portion 16*d* of the flexible container 16 are joined by the ultrasonic staking. As illustrated in FIGS. 7B, 7C, and 8A, a portion close to the junctional portion 22 of the ultrasonic staking portion of the first fixing portion 18*a* is the fixing portion 18*c*.

Firstly, as illustrated in FIG. 4A, the rotating member 20 rotates in a direction indicated by an arrow C by receiving a driving force from a driving unit (not shown) provided in the apparatus main body B. FIGS. 7A and 7B illustrate a state of right before the unsealing of the first junctional portion 22*a* is started when the sealing member 19 is pulled as the rotation of the rotating member 20 advances. With the rotation of the rotating member 20, the sealing member 19 fixed at the engaging portion 19*b* is pulled in the direction indicated by the arrow D by the corner portion 20*c* (force acting portion 20*a*) of the rectangular rotating member 20.

When the sealing member 19 is pulled, the flexible container 16 is also pulled via the junctional portion 22. The force is then applied to the first fixing portion 16*d* of the flexible container 16, and the flexible container 16 is pulled from the fixing portion 18*c* toward the force acting portion 20*a* by the fixing portion 18*c*. On a cross section perpendicular to the rotation axis of the rotating member 20, the first junctional portion 22*a* is moved to approach a line that connects the force acting portion 20*a* and the fixing portion 18*c*. At this time, in the direction indicated by the arrow D, the opening portion 35*a*, the first junctional portion 22*a*, the turn-back portion 19*d*, and the fixing portion 18*c* are arranged in this order from the rotation axis of the rotating member 20 (FIG. 7B). As the sealing member 19 is turned back at a place between the first junctional portion 22*a* and the engaging portion 19*b*, the force is applied to a portion of the first junctional portion 22*a* so that the portion of the first junctional portion 22*a* is taken off in an inclined manner in the direction indicated by the arrow D. The take-off of the first junctional portion 22*a* is then performed, and thus the unsealing of the discharging portion 35 is started.

The force noting portion 20*a* is also moved in the direction indicated by the arrow C together with the corner portion 20*c*, and when a corner portion 20*d* and the sealing member 19 are brought into contact with each other, the force acting portion is moved from the corner portion 20*c* to the corner portion 20*d*. FIG. 7B illustrates a state in which the force acting portion 20*a* is at the corner portion 20*c*, and FIG. 7C illustrates a state in which the force acting portion 20*a* is moved to the corner portion 20*d* with the rotation of the rotating member 20.

Figure 8B:
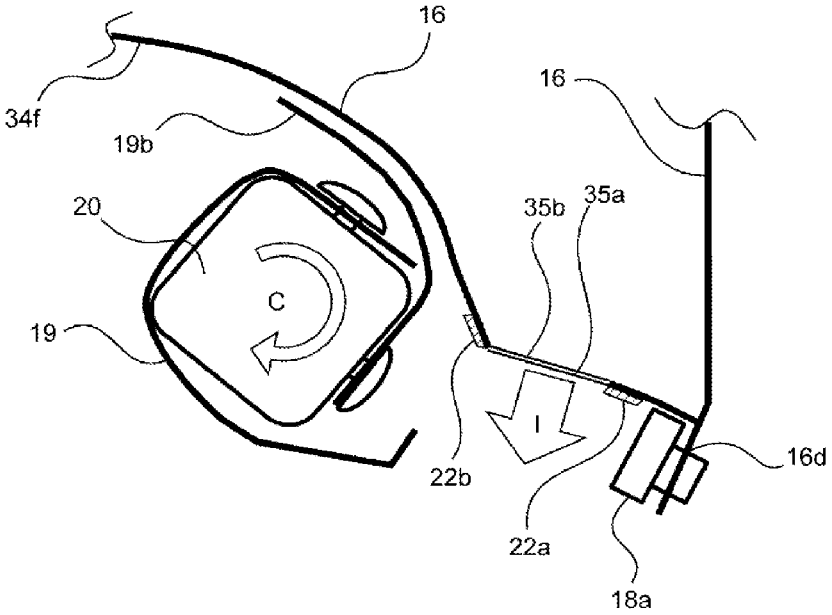
Figure 9:
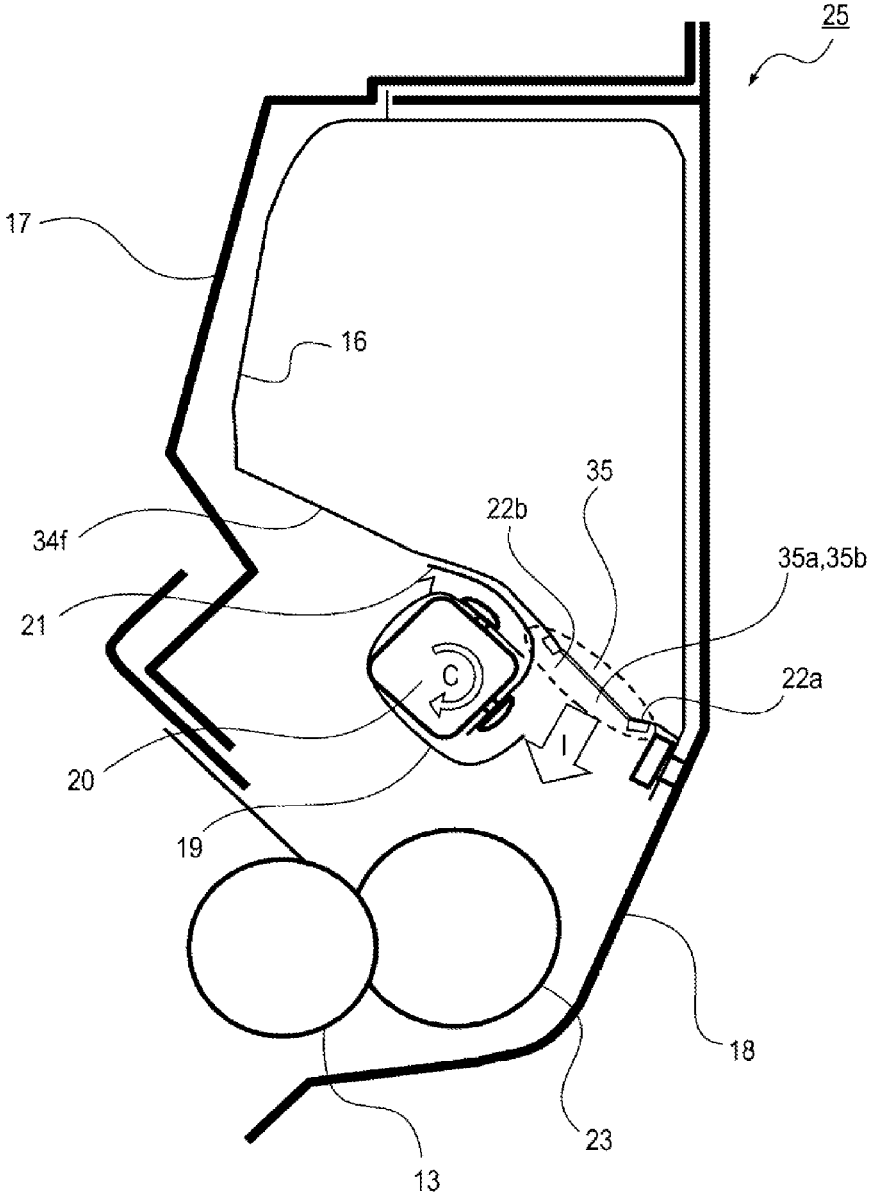
FIG. 9 is a cross-sectional view illustrating an operation of the pressure member.

As illustrated in FIGS. 6 and 7, as the rotation of the rotating member 20 advances, the unsealing is advanced, and at the same time, the turn-back portion 19*d* is also moved in the direction indicated by the arrow E. The unsealing is then further advanced so that the opening portion 35*a* is exposed. FIG. 8A illustrates a state in which the separating of the second junctional portion 22*b* is started after the opening portion 35*a* is exposed. At this lime as well, the sealing member 19 is pulled toward the force acting portion 20*a* in the same manner as the separating of the first junctional portion 22*a*, and the flexible container 16 counteracts in a direction of the fixing portion 18*c* (direction indicated by an arrow H). In the cross section perpendicular to the rotation axis of the rotating member 20, the second junctional portion 22*b* is moved to approach the line which connects the force acting portion 20*a* and the fixing portion 18*c*. The force in the direction indicated by the arrow D is then applied to a portion of the second junctional portion 22*b* so that the second junctional portion 22*b* is separated. The second junctional portion 22*b* is separated and the unsealing is completed (FIGS. 8B and 9). The developer in the flexible container 16 is then discharged in a direction indicated by an arrow 1 through the opening portions 35*a* of the discharging portion 35.

In this manner, the sealing member 19 is wrapped around the rotating member 20 by the rotation of the rotating member 20 to separate the junctional portion 22. A space required for the rotating member 20 to move, around which the sealing member 19 is wrapped by the rotation, can be as small as a space enough for the rotating member 20 to rotate. Thus, the space can be saved compared to a case where the sealing member 19 is moved by a movement other than the rotation. Alternatively, the user may rotate the rotating member 20 to wrap the sealing member 19 around the rotating member 20 so that the opening portion 35*a* is exposed. However, it is more preferred that the rotating member 20 he rotated by a driving from the apparatus main body B to wrap the sealing member 19 around the rotating member 20 without help from a user.

Further, the junctional portion 22 can be separated in an inclined manner without shear separating the junctional portion 22 by providing the turn-back portion 19*d* on the sealing member 19, and thus the junctional portion 22 can be unsealed without fail. In addition, the engaging portion 19*b* which is engaged with the relating member 20 for taking off the sealing member 19 is provided at one end portion of the sealing member 19 in the direction substantially perpendicular to the direction indicated by the arrow F along which the plurality of opening portions 35*a* are arranged, and hence the sealing member 19 can be engaged and unsealed without fail. Moreover, by providing the fixing portion 18*c* on the frame 18 and supporting the flexible container 16 at the time of unsealing, even the flexible container 16 which is soft and deformable can be unsealed without fail. Regarding the discharge of the developer at the time of unsealing, the junctional portion 22 is moved on the line which connects the force acting portion 20*a* and the fixing portion 18*c* at the time of unsealing as described above (FIG. 7A→FIG. 7B→FIG. 7C→FIG. 8A). The developer near the opening portion 35*a* is moved by this movement so that an agglomeration of the developer can be broken.

Outline of Pressure Member and Discharge of Developer

Pressure Member

Figure 16:
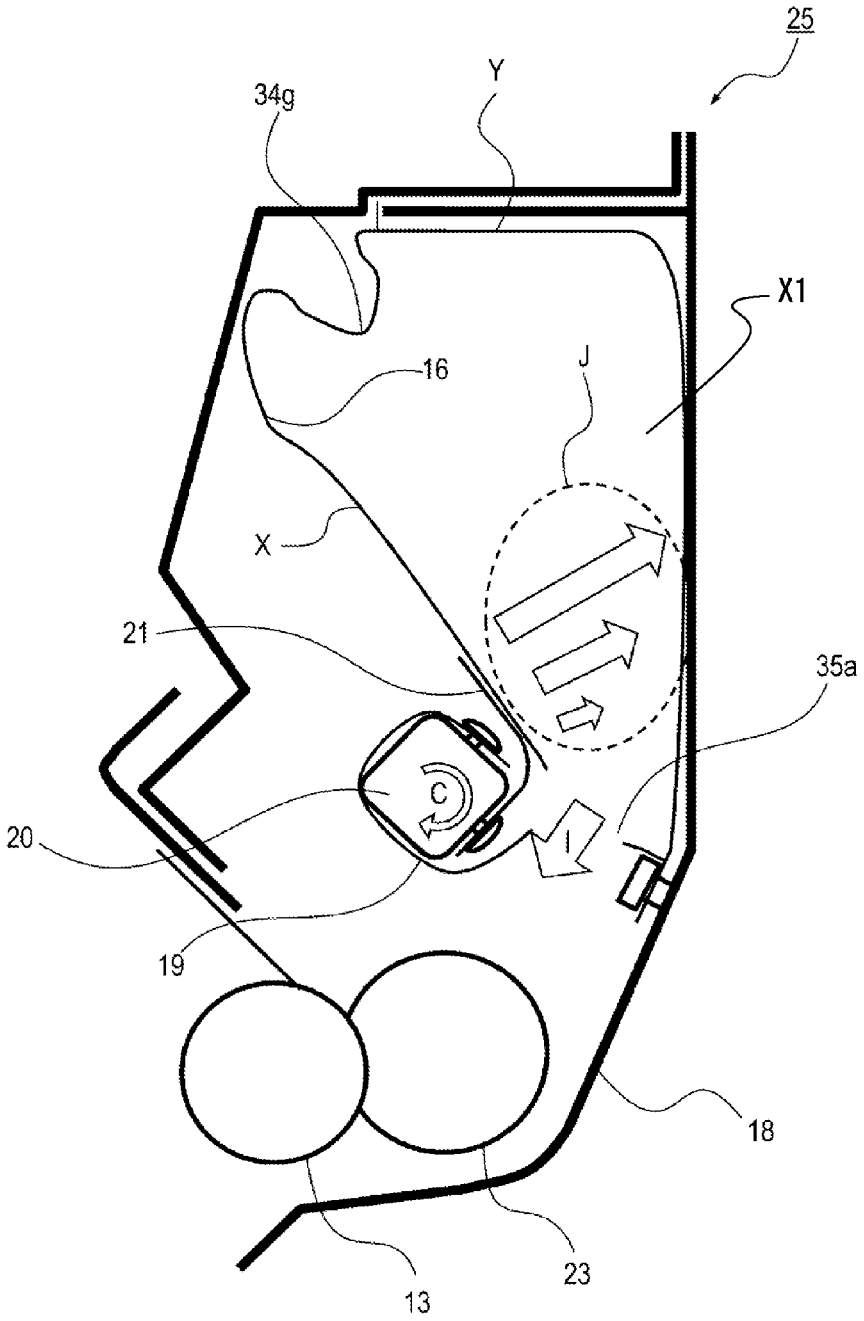
FIG. 16 is a cross-sectional view illustrating an operation of the flexible container inside the frame.
Figure 17:
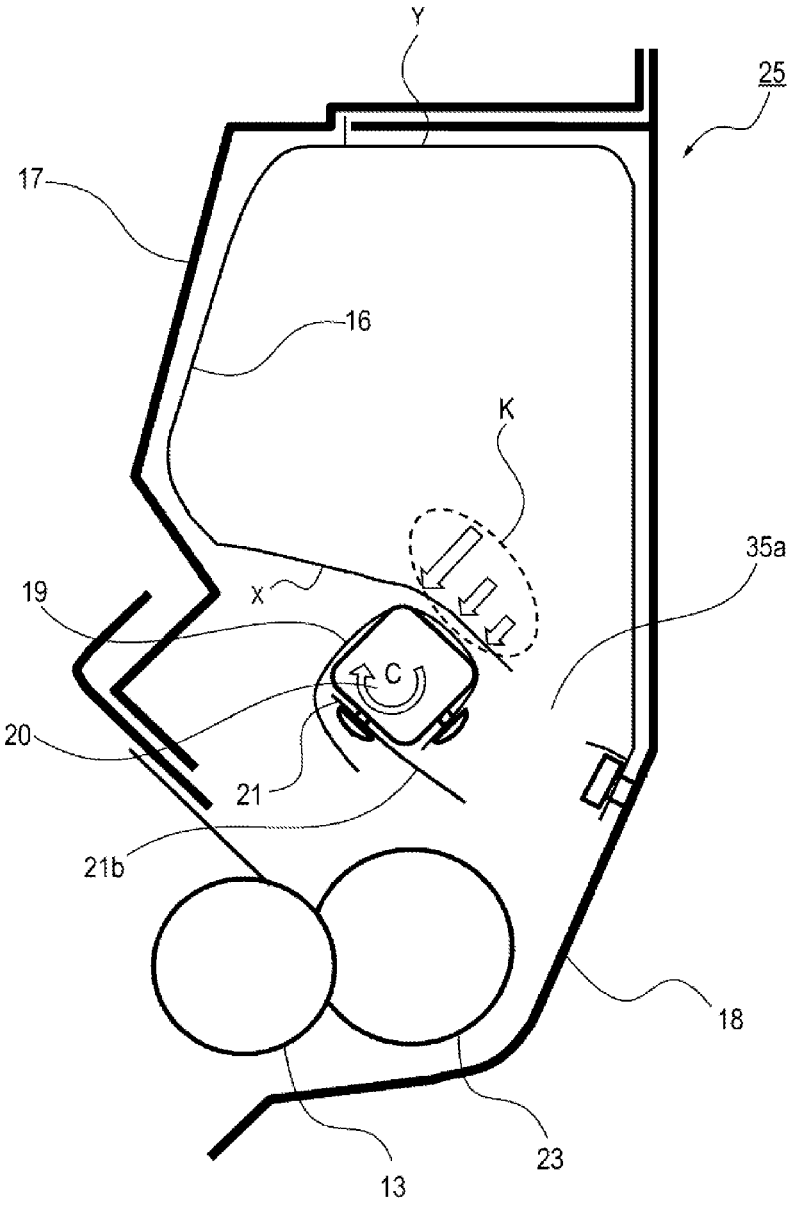
FIG. 17 is a cross-sectional view further illustrating the operation of the flexible container inside the frame.

As illustrated in FIGS. 16 and 17, the pressure sheet 21 is fixed on one surface of the rotating member 20 which has a rectangular cross section, and the rotating member 20 rotates in the direction indicated by the arrow C by receiving a driving force from a driving unit in the apparatus main body B. The pressure sheet 21 is then rotated together therewith in the direction indicated by the arrow C. The pressure sheet 21 is a flexible sheet of PET, polyphenylene sulfide (PPS), or polycarbonate with a thickness of about 0.05 mm to 0.1 mm. A leading end portion of the pressure sheet 21 is protruded in an outward direction than a circumscribing circle of the rotating member 20. In the embodiment, the sealing member 19 and the pressure sheet 21 are respectively fixed on different surfaces of the rotating member 20 from each other. However, the sealing member 19 and the pressure sheet 21 can also be fixed on the same surface of the rotating member 20.

Further, as illustrated in FIGS. 16 and 17, the pressure sheet 21 also has a function of agitating the developer and conveying the developer toward the developing roller 13 and the supplying roller 23.

Outline of Discharge of Developer from Flexible Container

Outline of Discharge of Developer at Time of Unsealing from Before Unsealing Regarding the discharge of the developer at the time of starting unsealing from before unsealing, the sealing member 19 is pulled toward the force acting portion 20*a* as illustrated in FIGS. 7B, 7C, and 8A (arrow D), and the flexible container 16 is supported at the fixing portion 18*c* of the frame 18. Therefore, the three points including the force acting portion 20*a*, the fixing portion 18*c* of the frame 18, and the portion where the junctional portion 22 is separated are moved in a direction along which the three points are arranged in a straight line on the cross section perpendicular to the rotation axis of the rotating member 20 at the time of unsealing. In this manner, a position of the opening portion 35*a* is changed between the time before performing the unsealing operation by the rotating member 20 applying the force to the sealing member 19 and the time when the unsealing operation is started so that the first junctional portion 22*a* is separated, and hence the developer can be prevented from stagnating near the opening portion 35*a* so that the discharge performance can be enhanced.

Outline of Discharge of Developer after Unsealing—at Time of Pressing

As illustrated in FIG. 8B, after the sealing member 19 is taken off from the flexible container 16, because the opening portions 35*a* are arranged to open in the downward direction of the flexible container 16, the developer near the opening portions 35*a* is discharged by an action of the gravity and a vibration of the flexible container 16 at the time of unsealing.

When the rotating member 20 further rotates after unsealing, the pressure sheet 21 which presses the flexible container 16 and is fixed to the rotating member 20 is also rotated and wrapped around the rotating member 20 due to the presence of the flexible container 16 as illustrated in FIG. 9. The pressure sheet 21 has elasticity as illustrated in FIG. 16, and hence the pressure sheet 21 is about to return to the original shape. Thus, the pressure sheet 21 presses the flexible container 16 in a direction indicated by arrows J in an upper side space X1. At this time, the flexible container 16 is pressed by the pressure sheet 21 and by the frame 18 via the contained toner so that the entire flexible container 16 is deformed. Further, a volume of the flexible container 16 is decreased by being pressed by the pressure sheet 21. In this manner, due to the decrease of the volume and the change of the entire shape of the flexible container 16, the developer in the flexible container 16 is agitated, and thus the developer becomes easily discharged from the opening portion 35*a*. Further, portions of the flexible container 16 other than the opening portion 35*a* are closed at this time so that there is no escape route of the developer other than the opening portion 35*a*, and hence the discharge performance through the opening portion 35*a* is increased. With the above-mentioned discharge operation, the developer is easily discharged in a direction indicated by the arrow I.

At this time, the flexible container 16 can be deformed as long as at least a portion of the flexible container 16 is brought into abutment against the frame 18 and pressed. In addition, by aligning a rotation axis direction of the developing roller 13 and the direction indicated by the arrow F along which the plurality of opening portions 35*a* are arranged, the developer can be easily supplied along the entire longitudinal direction of the developing roller 13 in an unbiased manner when discharging the developer When the flexible container 16 is mounted on the image forming apparatus 100, the discharge performance of the developer can be enhanced by providing the flexible container 16 in such a manner that the opening portion 35*a* is opened in the direction of the gravity. Further, the pressure sheet 21 is provided in the frames (17 and 18) so as to press the flexible container 16 against the frame 18, and hence the discharge performance of the developer can be enhanced. Further, the sealing member 19 also employs a flexible sheet made of a base material such as polyethylene terephthalate (PET), polyethylene, and polypropylene with a thickness of 0.03 mm to 0.15 mm, and hence the sealing member 19 contributes to the discharge operation by the same mechanism as that of the pressure sheet 21.

Outline of Discharge of Developer—Recovery of Shape of Flexible Container

As illustrated in FIG. 17, the rotation of the rotating member 20 farther advances, and then the pressure sheet 21 is separated from the flexible container 16. At this rime, the flexible container 16 has the flexibility, and hence the flexible container 16 is about to return to a state before being pressed, due to the weight of the developer contained in the flexible container 16 (arrows K). The sealing member 19 is then also rotated and presses the flexible container 16 against the frame 18 so that the flexible container 16 is deformed, and hence the developer other than near the opening portions 35*a* is also moved and discharged from the opening portions 35*a*.

Outline of Discharge of Developer—Repetition of Pressing/Recovery

In the case of immediately after unsealing in which the developer exists in the flexible container 16 in a large amount, inroad amounts of the pressure sheet 21, the sealing member 19, and the rotating member 20 into the flexible container 16 are repeatedly changed so that the flexible container 16 is deformed to be pressed against the frame 18. A compression of the flexible container 16 by the pressure of the pressure sheet 21 and a recovery of the flexible container 16 by the weight of the developer in the flexible container 16 and the flexibility of the flexible container 16 are repeated. Further, the flexible container 16 is vibrated due to a movement of the flexible container 16 itself by the above-mentioned action, and the developer in the flexible container 16 is also discharged from the opening portions 35*a* due to the vibration. The pressure sheet 21 is rotated, and hence the pressure sheet 21 can repeatedly press the flexible container 16.

Serving as Pressure Sheet and Sealing Member

Further, a single component can be configured to have both functions of the pressure sheet 21 and the sealing member 19. The junctional portion 22 is separated from the flexible container 16 after unsealing, and hence the end portion of the sealing member 19 on the side of the junctional portion 22 becomes a free end. Therefore, the sealing member 19 can have the function of the pressure sheet 21. In this manner, the rotating member 20 can have the function of the rotating member 20 of the pressure sheet 21 and the sealing member 19 can have the function of the pressure sheet 21. With this configuration, the number of components can be reduced so that the cost can be reduced.

As described above, the developer in the flexible container 16 can be efficiently discharged without providing other discharging component such as a developer discharging roller on the opening portion 35*a* which is a developer discharging port, and agglomeration and bridge of the developer near the opening portion 35*a* can be prevented. As a result, even when the developer in the flexible container 16 is hardened due to tapping at the lime of transportation or storing, a situation in which the discharge of the developer is difficult can be prevented by breaking a lump of the developer by movement of the entire flexible container 16 or surroundings of the opening portions 35*a*.

Example of Single Component as Pressure Member

Figure 11A:
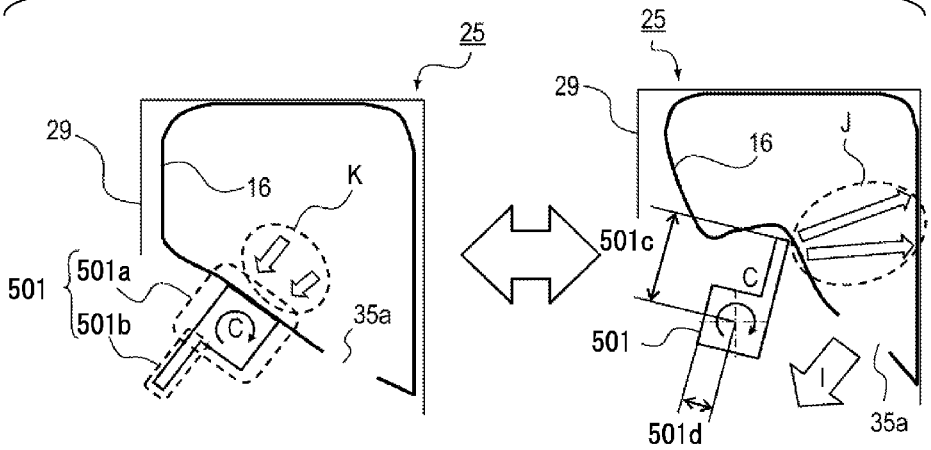
FIGS. 11A, 11B, and 11C are cross-sectional views illustrating other configurations of the pressure member.
Figure 11B:
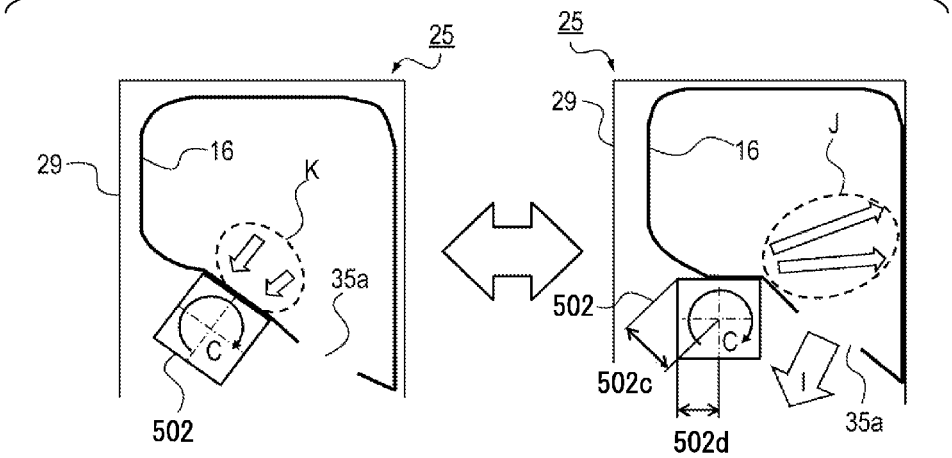
Figure 11C:
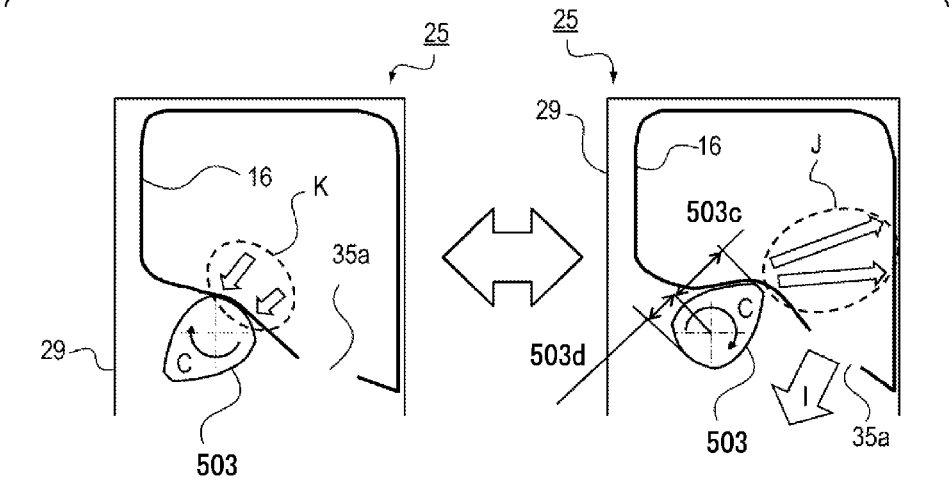

In addition, instead of the pressure member 500 comprising the pressure sheet 21 and the rotating member 20 as separate components, a pressure member 501 comprises a protruded portion 501*b* which functions as the pressure sheet 21 provided on a rotating portion 501*a* as an integrated component so as to perform the discharge of the developer in the same manner as illustrated In FIG. 11A. When the pressure member 502 or 503 is configured only with the rotating member, in a case where the cross section of the rotating member is a polygon (FIG. 11B) or a cam shape (FIG. 11C) when viewed from a cross section perpendicular to the rotation center, the flexible container 16 can be pressed against a frame 29 to deform the flexible container 16.

This is because the inroad amount of the pressure member 501, 502, 503 into the flexible container 16 is changed because a distance (501*c*, 501*d*; 502*c*, 502*d*; 503*c*, 503*d*) from the rotation center of the pressure member 501, 502, 503 to an outer shape is changed if the pressure member 501, 502, 503 is arranged at least to be brought into contact with the flexible container 16. That is, except when a shaft having a circular cross section with the rotation axis at the center is provided, the flexible container 16 can be deformed by the rotation of the pressure member 501, 502, 503. As illustrated in PIG 11A, a distance 501*c* from the center of the pressure member 501 to the leading end of the protruded portion 501*b* which is the far outer shape and a distance 501*d* from the center of the pressure member 501 to the close outer shape of the rotation member 501*a* are different from each other, and hence the inroad amount of the pressure member 501 into the flexible container 16 is also changed.

Figure 5A:
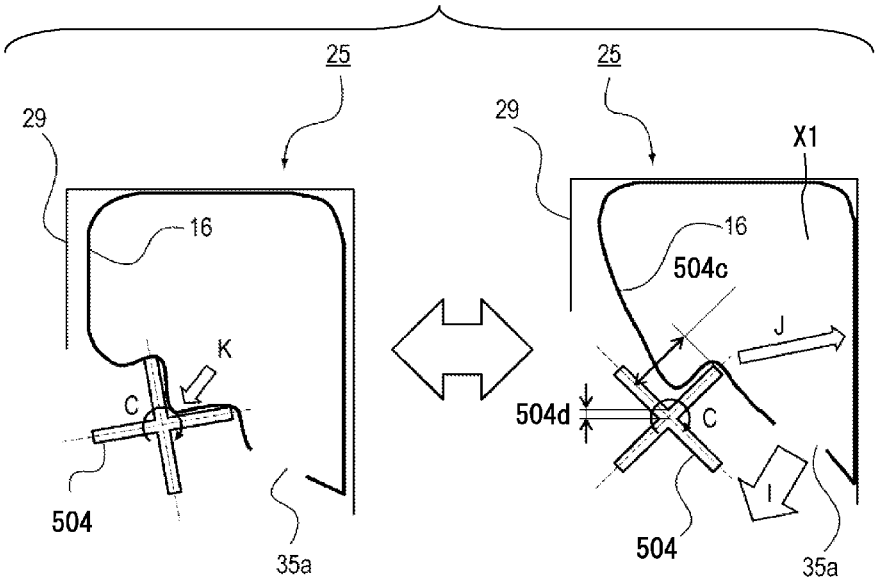
FIGS. 5A and 5B are cross-sectional views illustrating another configuration of a pressure member.
Figure 5B:
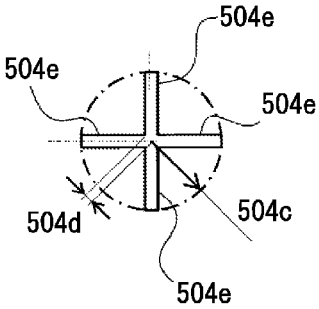

Further. FIG. 5B is a cross-sectional view of the pressure member 504 having a cross-shaped cross section, and FIG. 5A is a cross-sectional explanatory view of the developer containing unit 25 including the pressure member 504 formed in the cross shape. As illustrated in FIG. 5B, when the pressure member 504 includes four protruded portions 504*e* having the same distance from the center to the outer shape of the pressure member 504, outer shapes (504*c*) of the four protruded portions 504*e* are equal to each other. However, the pressure member 504 includes portions of the outer shapes (distance 504*d*) which are close to the center other than the protruded portions 21*e*, and hence the inroad amount of the pressure member 504 into the flexible container 16 can be changed. That is, in a cross section perpendicular to the rotation center of the pressure member 504, the pressure member 504 can be provided as a rotating member which includes portions having difference distances from the rotation center of the pressure member 504 to the outer shapes of the pressure member 504.

In this manner, the flexible container 16 is pressed (arrows J in the upper side space X1) by the pressure member 504 as the pressure member against the frame 29 to be deformed so that the volume of the flexible container 16 is reduced, and thus the developer in the flexible container 16 is pushed and discharged from the opening portion 35*a* (arrow I).

Further, in the attitude at the time of forming an image, the rotating member 20 of the pressure sheet 21 is Located under the flexible container 16 in the direction of the gravity and is brought into contact with the flexible container 16. The cross-sectional shape of the rotating member 20 of the pressure sheet 21 is rectangular, which is not circular, and hence the inroad amount of the rotating member 20 into the flexible container 16 is periodically changed by the rotation of the rotating member 20 as described above. By the change of the inroad amount of the rotating member 20 into the flexible container 16, the volume of the flexible container 16 can also be changed, and hence the discharge performance can be enhanced by vibrating the flexible container 16.

Outline of Whereabouts of Developer after Unsealing

Figure 18:
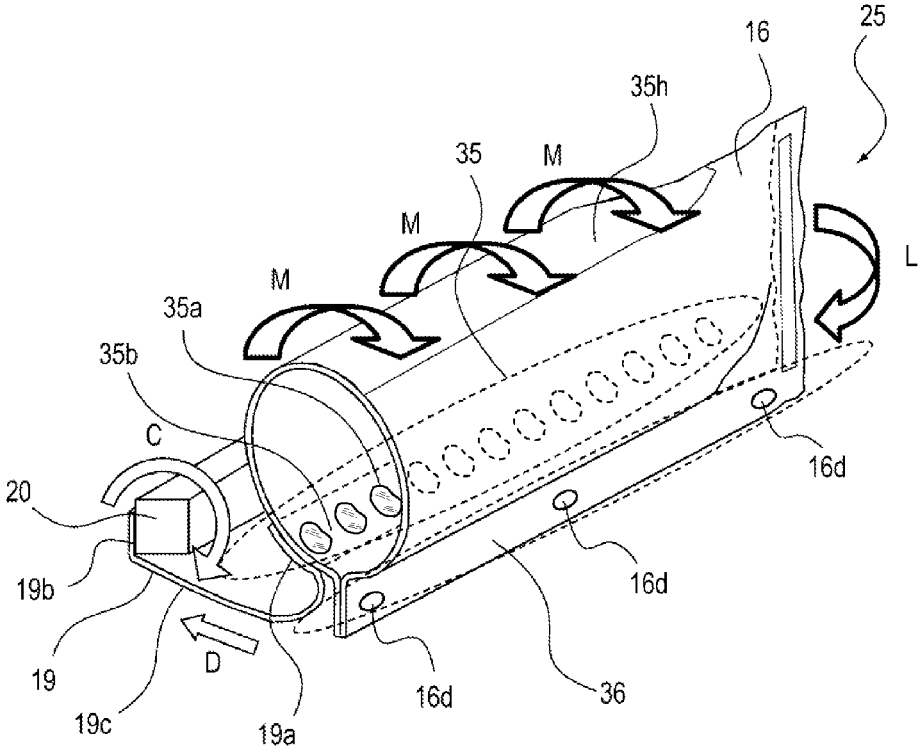
FIG. 18 is a perspective view illustrating the configuration of the flexible container.
Figure 19:
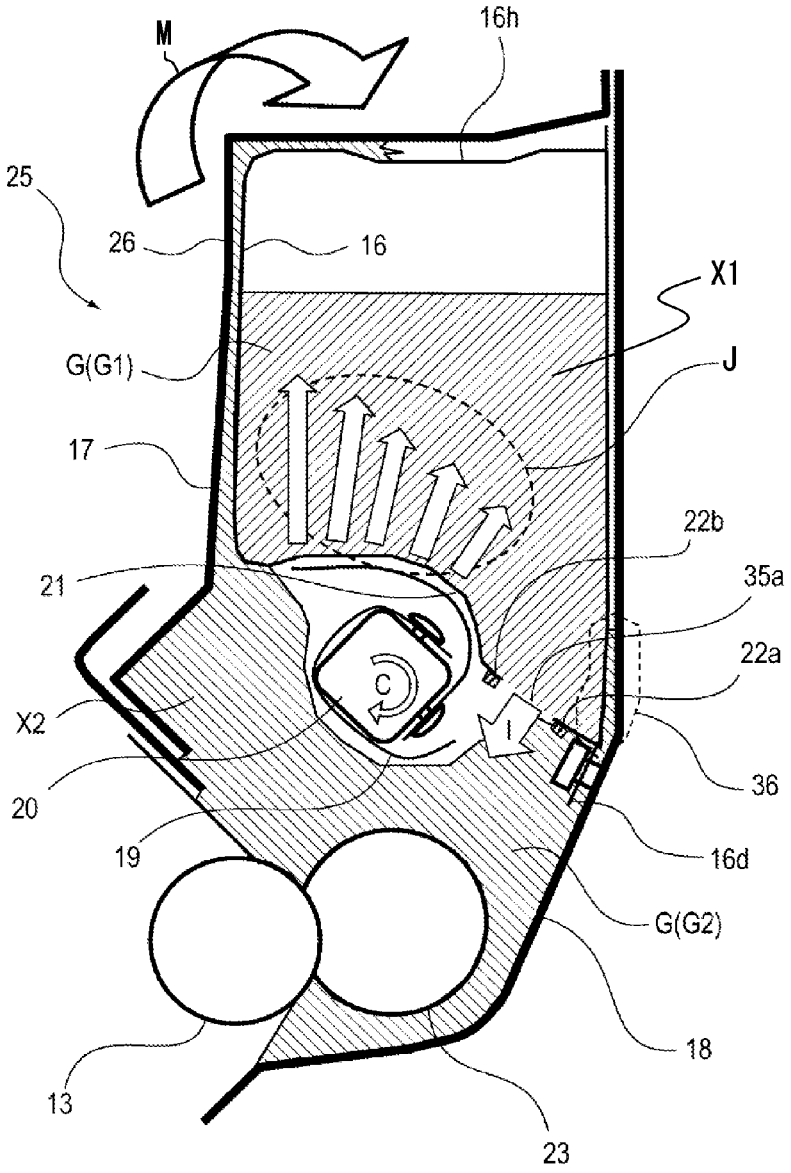
FIG. 19 is a cross-sectional view illustrating the inside of the frame.
Figure 20:
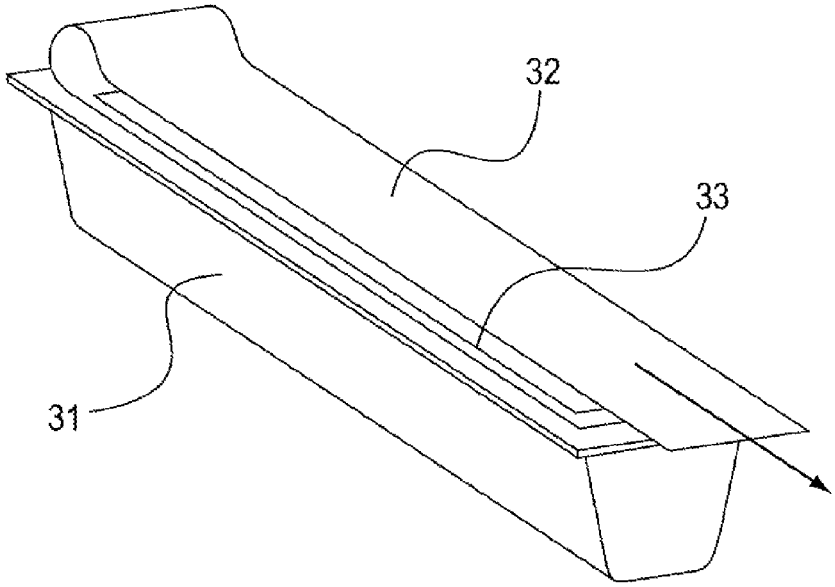
FIG. 20 is a perspective view illustrating a configuration of a developer containing frame according to a conventional example.

FIG. 18 is a perspective view of the developer containing unit 25 obtained by cutting the developer containing unit 25 at a position corresponding to an end portion of the flexible container 16. FIG. 19 is a cross-sectional view of the developer containing unit 25, where the whereabouts of the developer is illustrated as hatched portions. The whereabouts of the developer after unsealing is described with reference to FIGS. 18 and 19.

Firstly, as illustrated in FIG. 1, in the inside of the cartridge A, the flexible container 16 is supported by the frames 17 and 18 at the fixing portion 16*d* so that a space is formed between the outer surface of the flexible container 16 and the inner surfaces of the frames 17 and 18. On the other hand, it can be easily speculated that the developer containing unit 25 is headed toward various directions in accordance with a usage state of a user even after the flexible container 16 is unsealed. As a result, the developer enters the space sandwiched by the outer surface of the flexible container 16 and the inner surfaces of the frames 17 and 18, and because there is no discharge path for the developer, the developer is accumulated in the developer containing unit 25 and may not function as the developer.

When the unsealing of the opening portion 35*a* of the flexible container 16 is completed with transition from the state illustrated in FIG. 18 to the suite illustrated in FIG. 19, normally, the developer G is delivered toward the developing roller 13 by the conveying action of the rotating mechanism (the rotating member 20, the pressure sheet 21, and the sealing member 19) which is a "pressure unit".

At this time, the developer G is supplied to the developing roller 13, and at the same time, as shown by an arrow M in FIG. 19, the developer G is kicked up in a direction indicated by the arrow M due to u generation of a pressure in the direction indicated by the arrows J of the upper side space X1 toward the inside of the frame 17 of the developer containing unit 25. The developer then may enter a saddle portion 16*h* of the flexible container 16 which is the top portion of the flexible container 16, which is formed by the weight of the entering developer. By the continuation of the conveying action of the pressure sheet 21, the developer G may be accumulated on the saddle portion 16*h*. Thus, the saddle portion 16*h* is expanded due to the weight of the developer G, causing a further entering of the developer G.

In addition, the cartridge A may be headed toward various directions in accordance with the usage state of the user even after unsealing, and hence the movement of the developer G in a direction such as the arrows J in the upper side space X1 illustrated in FIG. 19 may be expedited. In a state in which the cartridge A is mounted on the apparatus main body B, there is no path for discharging the developer G from a space 26 which is formed by the flexible container 16 and the frame 18, which is on a rear side across the flexible container 16 with respect to the space in which the pressure sheet 21 conveys the developer to the developing roller 13 (see FIG. 19). Therefore, this developer cannot be used in the image formation.

First Embodiment

Outline of Measure to Prevent Entering of Developer

Figure 15:
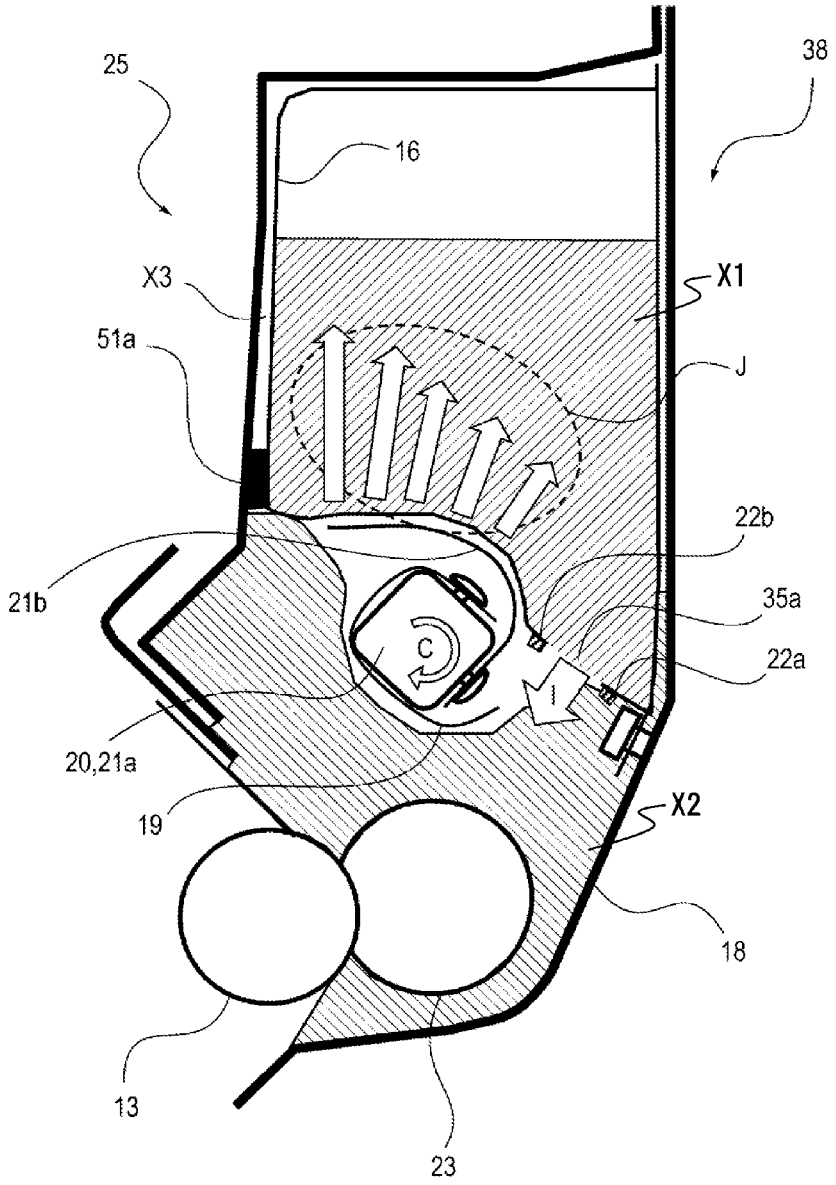
FIG. 15 is a cross-sectional view illustrating a configuration of a developer containing unit according to a first embodiment of the present invention.

FIG. 15 is a cross-sectional view of the developer containing unit 25. In the following description, the upper side space X1 refers to a space inside the frame 17, which is specifically a space inside the flexible container 16. Further, a lower side space X2 refers to a space inside the frame 18, which is specifically a space lower than the flexible container 16 (a space hatched with a diagonal line obliquely downward right in FIG. 15) among spaces surrounded by the frame 17 and the frame 18. Moreover, a gap space X3 refers to a gap between the frame 17 and the flexible container 16, which is a space other than the lower side space X2.

A method of preventing the developer from entering the gap space X3 corresponding to the upper side of the fixing portion will he described below with reference to FIG. 15. The developer containing unit 25 includes an abutment portion 51*a*. The abutment portion 51*a* is a member configured to bring a portion of the flexible container 16 into abutment against a portion of the frames 17 and 18. Viewed from a region where there is no flexible container 16 in the frames 17 and 18, the abutment portion 51*a* is provided at an entering portion of an opening surrounded by the frames 17 and IS and the flexible container 16. The abutment portion 51*a* has viscosity or adhesiveness extending in the longitudinal direction with respect to the portion of the frames 17 and 18 and viscosity or adhesiveness extending in the longitudinal direction with respect to the portion of the flexible container 16.

Specifically, the abutment portion 51*a* is arranged at a position where the developer starts to enter the gap between the frame 17 and the flexible container 16 from the space for conveying the developer to the developing roller 13 due to a pressure in the direction indicated by the arrows J in the upper side space X1 generated by the conveying action of the pressure sheet 21. Further, the abutment portion 51*a* is arranged along the longitudinal direction of the frame 17 to be brought into abutment against without a gap against both the frame 17 and the flexible container 16 by using an adhesive agent, a pressure-sensitive adhesive agent, or a double-sided tape.

As illustrated in FIG. 15, the abutment portion 51*a* is arranged at a portion of the frame 17 where the developer starts to enter the gap between the frame 17 and the flexible container 16 from the space for conveying the developer to the developing roller 13 due to a pressure in the direction indicated by the arrows J in the upper side space X1 generated by the conveying action of the pressure sheet 21. The abutment portion 51*a* is configured to be brought into abutment without a gap against both the frame 17 and the flexible container 16 along the longitudinal direction of the frame 17 (direction perpendicular to a paper plane of the drawing).

With this configuration, the abutment portion 51*a* can prevent the developer G2 from entering the gap between the flexible container 16 and the frame 17. By reducing the developer G2 which enters through the back of the frame 17, the developer G2 used in the image formation can be increased so that the developer G2 can be used without waste.

In the first embodiment, the abutment portion 51*a* is a member which is brought into abutment against both the flexible container 16 and the frame 17 along the longitudinal direction of the frame 17, such as the adhesive agent, a pressure-sensitive adhesive agent, or the double-sided tape. However, a shape of the abutment portion 51*a* is not particularly limited, but, for example, a meandering shape can also be used so long as it is not discontinued along the way.

Second Embodiment

Figure 21:
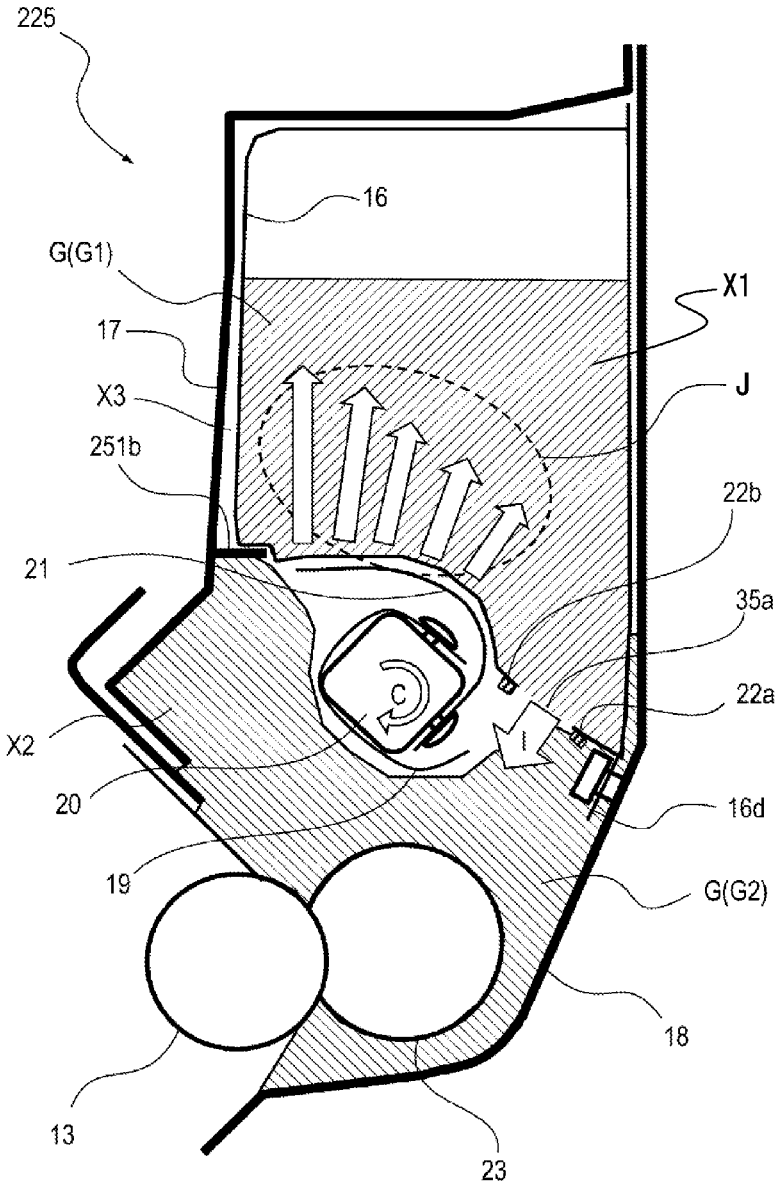
FIG. 21 is a cross-sectional view illustrating a configuration of a developer containing unit according to a second embodiment of the present invention.
Figure 25:
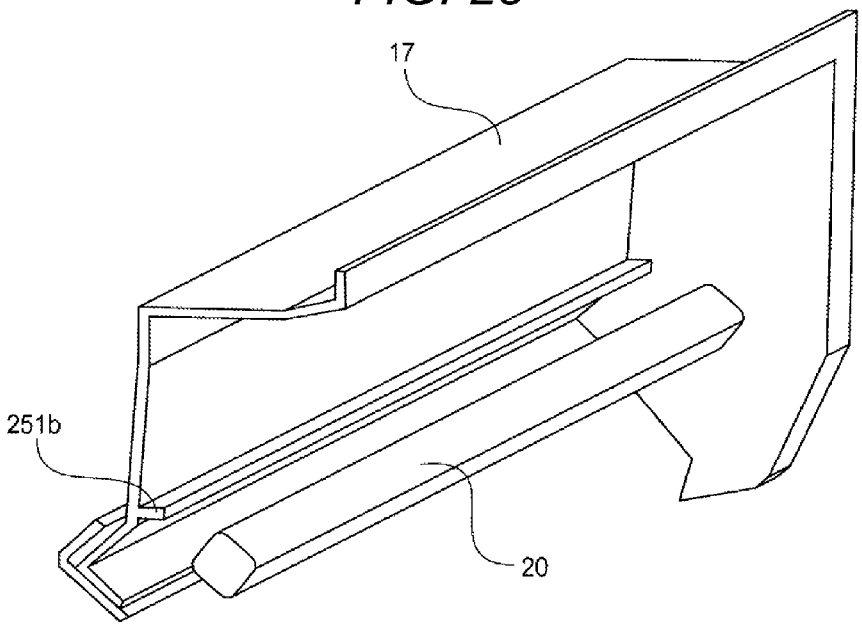
FIG. 25 is a perspective view illustrating a configuration of the frame.

FIG. 21 is a cross-sectional view illustrating a configuration of a developer containing unit 225. FIG. 25 is a perspective view illustrating a configuration of the frame 17. In the same manner as the first embodiment, a configuration configured to suppress the developer G2 from entering the gap space X3 from the lower side space X2 will he described.

As illustrated in FIGS, 21 mid 25, the developer containing unit 225 includes a rib 251*b* as a "frame-side protrusion" which is an "abutment portion" configured to bring a portion of the flexible container 16 into abutment against a portion of the frames 17 and 18. The rib 251*b* is provided on the portion of the frames 17 and 18, extended along the longitudinal direction, and protruded from the frames 17 and 18 toward the flexible container 16 (see FIG. 25).

In brief, the rib 251*b* is provided on the rear surface of the frame 17 to cover an opening where the gap between the frame 17 and the flexible container 16 starts. The rib 251*b* is extended toward the flexible container 16. Further, the rib 251*b* is extended along the longitudinal direction of the frame 17.

By a pressure in the direction indicated by the arrows J in the upper side space X1 generated by the conveying action of the pressure sheet 21, the developer G2 is directed to the rib 251*b* arranged at the gap between the frame 17 and the flexible container 16 from the space in the frame 18 for conveying the developer G2 to the developing roller 13. However, the rib 251*b* is brought into abutment against the flexible container 16, and hence the developer G2 can be prevented from entering the gap between the frame 17 and the flexible container 16 from the lower side space X2 for conveying the developer to the developing roller 13.

As illustrated in FIG. 21, the rib 251*b* is arranged at a portion where the developer starts to enter the gap between the frame 17 and the flexible container 16 from the lower side space X2 due to a pressure in the direction indicated by the arrows J in the upper side space X1 generated by the conveying action of the pressure sheet 21. The rib 251*b* is configured to be brought into abutment without a gap against both the frame 17 and the flexible container 16 along the longitudinal direction of the frame 17. With this configuration, the developer G2 can be prevented from entering the gap, and by reducing the developer which enters from the back, the developer used in the image formation can be increased so that the developer can be used without waste.

In the embodiment, the rib 251*b* is provided along the longitudinal direction. However, the rib 251*b* is not necessarily to be formed in a straight line shape, but, for example, an arc shape can also be used as long as an abutment relationship conforming to the stereoscopic shape of the flexible container 16 can be achieved.

Lopsidedness of Flexible Container and Output Image

Figure 28:
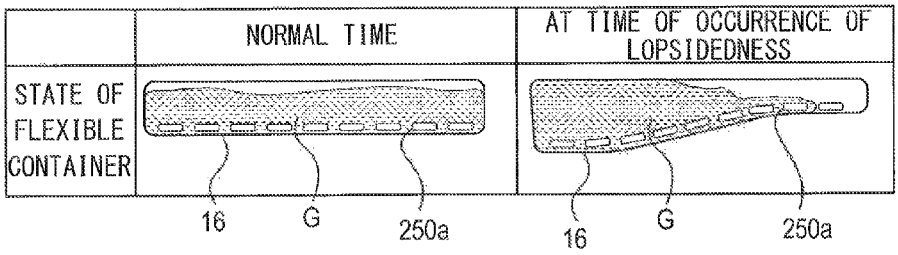
FIG. 28 is an image diagram illustrating a correlation between a state of a flexible container according to the second embodiment and an output image.

FIG. 28 illustrates states of the flexible container 16 at the time of a normal image forming operation and at the time when a lopsidedness in a direction along the rotation axis of the developing roller 13 occurs in the flexible container 16 and the developer G contained in the flexible container 16. The direction along the rotation axis of the developing roller 13 and the horizontal direction are hereinafter referred to as the longitudinal direction. Although there is no problem in the output image at the time of the normal image forming operation, an uneven density is likely to occur in the longitudinal direction in the output image at the time when the lopsidedness occurs.

The time of the normal image forming operation refers to a case when the developer containing unit 25 is stored in such an attitude that the rotation axis of the developing roller 13 is kept perpendicular to the direction of the gravity. The time when the lopsidedness occurs refers to a case when, right after a certain developer containing unit 25 is stored in a standing state in such an attitude that the rotation axis of the developing roller 13 is kept parallel to the direction of the gravity, the rotation axis of the developing roller 13 is returned to that in the attitude of the normal image forming operation, which is perpendicular to the direction of the gravity. The developer containing unit is hereinafter referred to as a developer containing unit in the standing state.

Even when the developer containing unit 25 in the standing stale is mounted on the image forming apparatus 100 and returned to the attitude of the normal image forming operation, the developer G is still in the agglomerated state, and hence the lopsided state in the above-mentioned longitudinal direction is maintained for the time being. This is because, when the lopsidedness occurs in the flexible container 16 in the longitudinal direction, a tension to return to the original state and a powder pressure of the developer G contained in the flexible container 16 due to the self weight are exerted to keep the balance in an inflated portion of the flexible container 16.

The above-mentioned state in which the developer containing unit 25 is in the standing state is an example in which the lopsidedness in the flexible container 16 and the developer G contained in the flexible container 16 is the largest, which is envisaged at the time of transporting the developer containing unit 25. Therefore, when the developer containing unit 25 is stored in the standing state, the uneven density is likely to occur in the output image, compared to the time of the normal image forming operation.

The reason why the uneven density occurs in the output image will be described below. A configuration in which the rib 251*b* functions as a support member configured to support the flexible container 16 to achieve an effect of suppressing the uneven density will be described. In a comparative example in which the rib 251*b* is not arranged, the above-mentioned uneven density is more likely to occur at the outset of the image output in which the developer G discharged from the flexible container 16 is not sufficiently stored in the developer containing unit 25.

That is, the output image is developed through a process in which the flexible container 16 is pressed by the pressure sheet 21, the developer G contained in the flexible container 16 is discharged from the opening portion 35*a*, the developer G is adhered on the supplying roller 23, and the developer G is supplied to the developing roller 13, and hence, when the discharging amount of the developer from the flexible container 16 differs in the longitudinal direction, the uneven density eventually occurs on the output image.

Effect of Support Member

In the embodiment, as illustrated in FIGS. 21 and 25, the rib 251*b* (support member) is arranged as an "abutment portion", and hence the lopsidedness which is likely to occur in the flexible container 16 in the longitudinal direction when the above-mentioned developer containing unit 25 is stored in the standing state is suppressed.

Figure 29A:
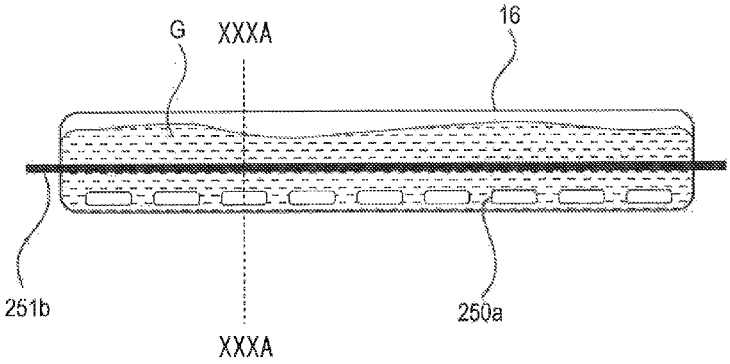
FIGS. 29A and 29B are plan views of the flexible container, for illustrating lopsidedness m a longitudinal direction.
Figure 29B:
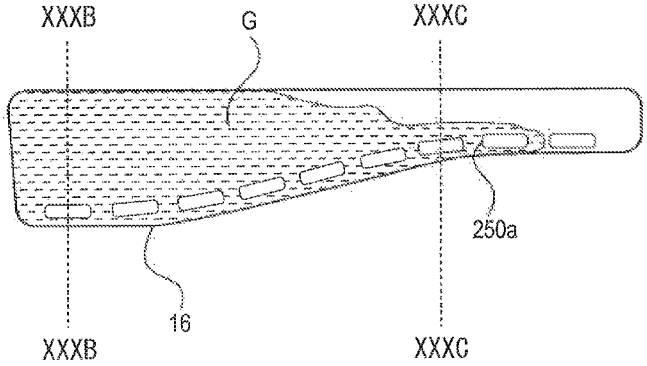

FIGS. 29A and 29B are image diagrams of the developer containing units according to the embodiment and the comparative example, respectively, in the longitudinal direction when the flexible container 16 is viewed from a side of the frame 17 before the sealing member 19 illustrated in FIG. 21 is taken off. FIG. 29A is a diagram corresponding to the embodiment in which the rib 251*b* is arranged so that the lopsidedness in the longitudinal direction is suppressed. FIG. 29B is a diagram corresponding to the comparative example in which the rib 251*b* is not arranged so that the lopsidedness in the longitudinal direction occurs in the flexible container 16.

As described above, when the developer containing unit 25 is in a standing state so that the lopsidedness occurs in the longitudinal direction, the developer G is densely agglomerated on the lower side in the vertical direction, and hence, as illustrated in FIG. 29B, a portion XXXB where the flexible container 16 is inflated is generated, compared to the upper side in the vertical direction. Further, a portion XXXC where the flexible container 16 is shrunken is generated on the upper side in the vertical direction. This illustrates a case where the left side in FIG. 29B is arranged on the lower side in the vertical direction and the right side in FIG. 29B is arranged on the upper side in the vertical direction.

Figures 30A, 30B, 30C:
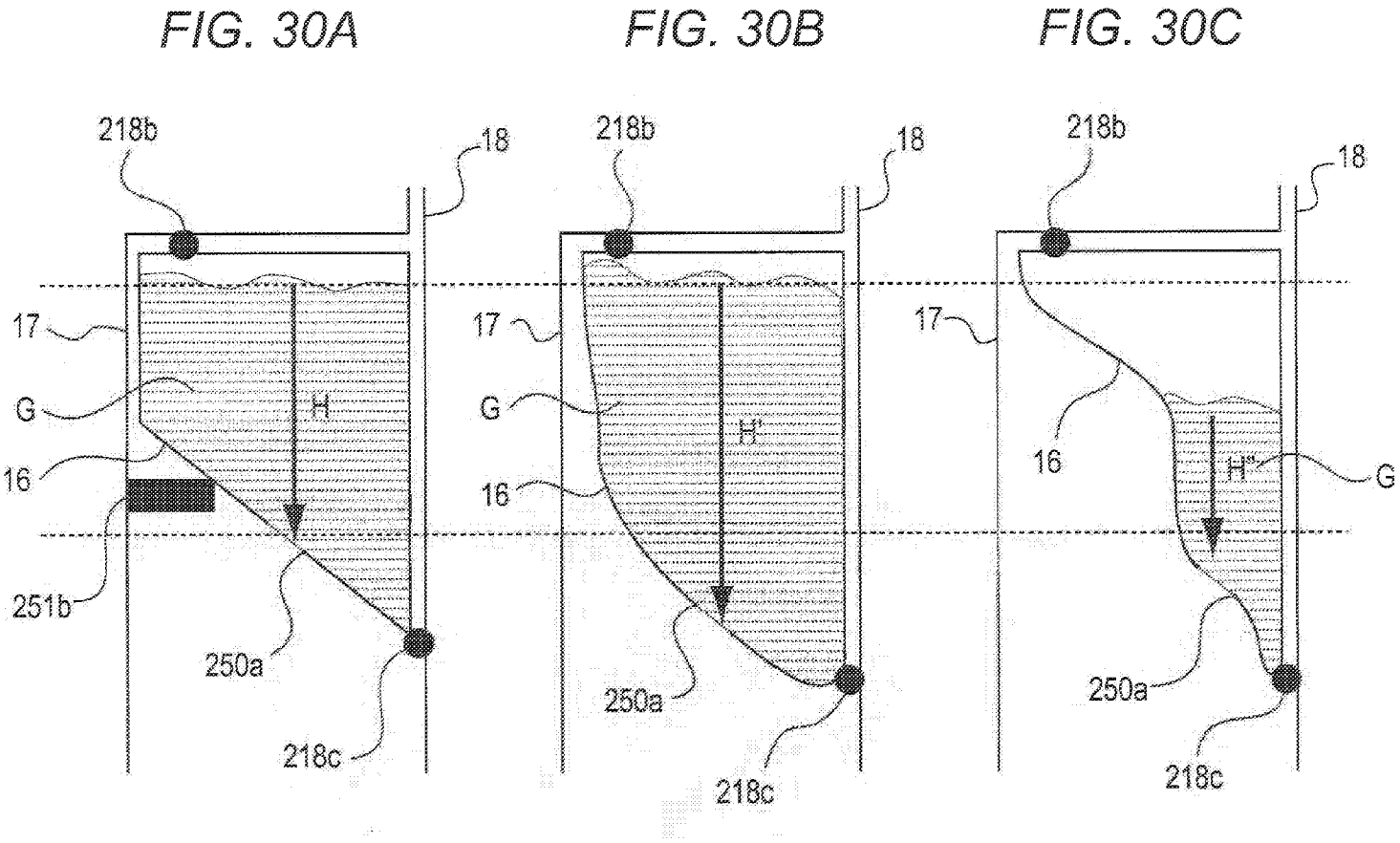
FIGS. 30A, 30B, and 30C are cross-sectional views of the flexible container, for illustrating the lopsidedness in the longitudinal direction.

FIGS. 30A, 30B, and 30C are image diagrams illustrating cross-sectional images of the developer containing unit, FIG. 30A is a diagram illustrating a cross-sectional image of the developer containing unit according to the embodiment taken along the lines XXXA-XXXA in FIG. 29A. FIG. 30B is a diagram illustrating a cross-sectional image of the developer containing unit according to the comparative example taken along the lines XXXB-XXXB in FIG. 29B, and FIG. 30C is a diagram illustrating a cross-sectional image of the developer containing unit according to the comparative example taken along the lines XXXC-XXXC in FIG. 29B. In FIGS. 30A, 30B, and 30C, a fixing portion 218*b* is provided to fix the frame 17 and the flexible container 16, and a fixing portion 218*c* is provided to fix the frame 18 and the flexible container 16.

As illustrated in FIG. 30B corresponding to the comparative example in which the rib 251*b* is not arranged, the developer G is densely agglomerated on the lower side in the vertical direction in a state in which the developer containing unit 25 is in a standing state, and the flexible container 16 is inflated, compared to the upper side in the vertical direction. Thus, a cross-sectional area of the flexible container 16 is increased on a cross section perpendicular to the rotation axis of the developing roller 13.

In FIGS. 30A, 30B, and 30C illustrating the cross sections, when the flexible container 16 is inflated to change from FIG. 30A to FIG. 30B, the amount of the developer existing on the upper side of an opening portion 250*a* in the vertical direction is increased. Supposing that the powder pressure of the developer against the opening portion 250*a* due to the developer's own weight is represented by an arrow H, when the state is changed from FIG. 30A to FIG. 30B, the powder pressure is increased from H to H'. When the powder pressure of the developer against the opening portion 250*a* is increased, a packing state advances, and hence it is hard to discharge the developer from the flexible container 16.

When the rib 251*b* is arranged as in the embodiment illustrated in FIG. 30A, the rib 251*b* is brought into contact with the flexible container 16 at a portion where the flexible container 16 is likely to be inflated on the lower side in the vertical direction, and hence the deformation of the flexible container 16 is suppressed. As a result, a change of the powder pressure of the developer against the opening portion 250*a* is suppressed, which suppresses the advance of the packing state, and hence the discharging performance of the developer G from the flexible container 16 is maintained. Therefore, the uneven density on the output image can be suppressed from occurring, As illustrated in FIG. 21, the rib 251*b* according to the embodiment is formed as a part of the frame 17, and arranged on the entire surface in the longitudinal direction at an end portion of a plane X including the opening portion. However, the rib 251*a* can be provided as a separate member, rather than a part of the frame 17. For example, the rib 251*b* may be bonded to the frame 17 or fitted into the frame 17, as a separate member.

In the embodiment, the rib 251*b* is brought into contact with the flexible container 16 even at the time of the above-mentioned normal image forming operation, i.e., when no lopsidedness occurs in the flexible container 16 in the longitudinal direction. However, the rib 251*b* can be arranged in proximity to the flexible container 16 and be configured to support the flexible container 16 to suppress the inflation of the flexible container 16 only when the lopsidedness occurs in the longitudinal direction on the plane X including the opening portion.

Arrangement Position of Support Member

Figure 32B:
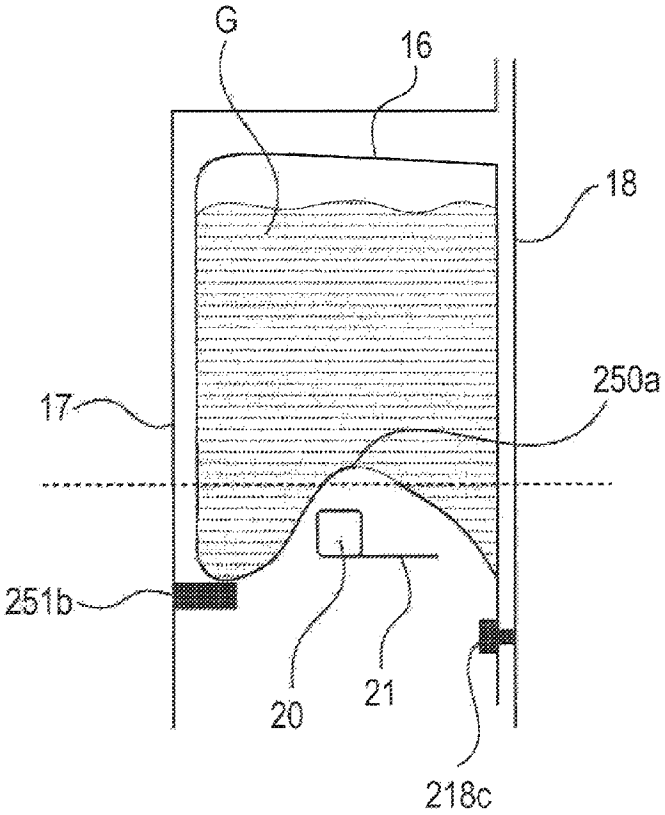
FIGS. 32A and 32B are cross-sectional views for illustrating a relationship between the arrangement of the support member according to the second embodiment and its effect.
Figure 32A:
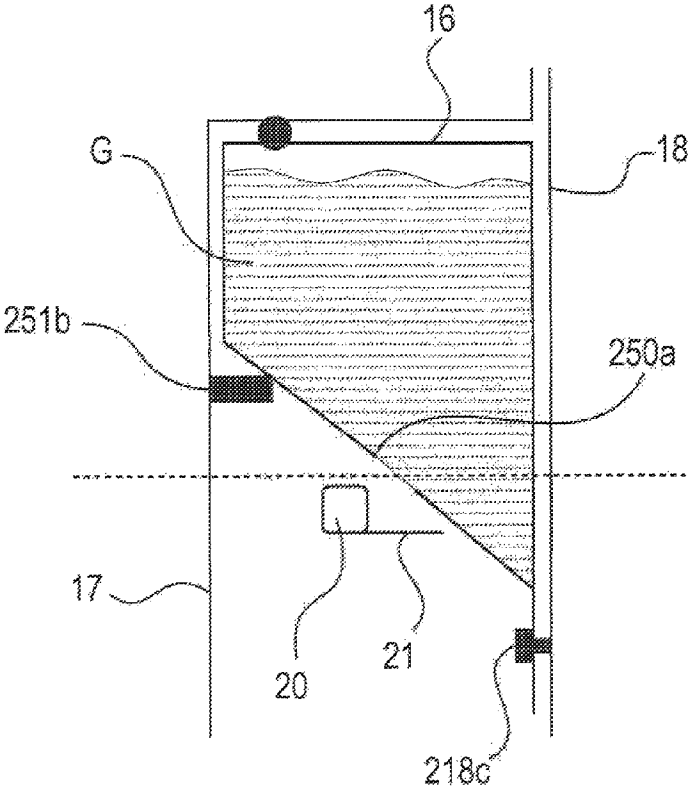

FIG. 32A is a diagram illustrating an embodiment in which the rib 251*b* is arranged above the opening portion 250*a* in the vertical direction, and FIG. 32B is a diagram illustrating a comparative example in which the rib 251*b* is arranged below the opening portion 250*a* in the vertical direction. As illustrated in FIG. 32B, when the rib 251*b* is arranged below the opening portion 250*a* in the vertical direction, the amount of the developer G existing below the opening portion 250*a* in the vertical direction is increased, and hence it is harder to discharge the developer G from the flexible container 16 than in the case where the rib 251*b* is arranged above the opening portion 250*a* in the vertical direction.

This is because the developer G must be pumped up against the gravity in a situation in which the opening portion 250*a* of the flexible container 16 is opened downwardly in the vertical direction so that the developer is easy to be conveyed in the direction of the gravity. Therefore, it is preferred that the rib 251*b* be arranged above the opening portion 250*a* in the vertical direction.

When the powder pressure of the developer against the opening portion 250*a* is increased, the packing state advances, and the discharge of the developer G from the flexible container 16 is deteriorated. A bridge generated near the opening portion 250*a* greatly contributes to the advance of the packing state, and hence the suppression of the downward deformation in the vertical direction is a reasonable measure for suppressing the packing. Therefore, in order to suppress the vertically downward deformation of the flexible container 16 near the opening portion 250*a*, it is effective to support a portion of the surface of the flexible container 16 where a component of the direction of the gravity due to the self weight of the developer G is received.

That is, in the attitude at the time of the normal image forming operation (a state In which the image forming operation can he performed), it is preferred that the support member be arranged at a position where the support member supports (abuts against) or is supportable for (or abuttable against) the portion of the surface of the flexible container 16 where the component of the direction of the gravity due to the self weight of the toner is received.

Third Embodiment

Figure 22:
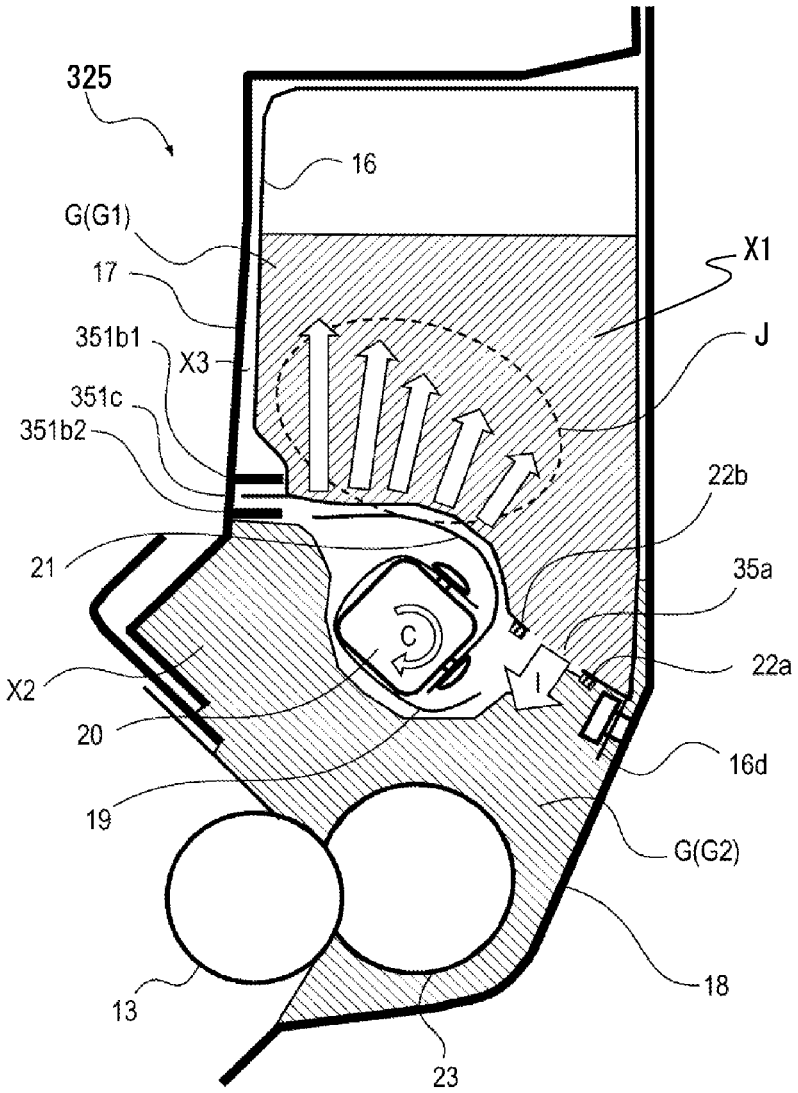
FIG. 22 is a cross-sectional view illustrating a configuration of a developer containing unit according to a third embodiment of the present invention.

FIG. 22 is a cross-sectional view illustrating a configuration of a developer containing unit 325. In the same manner as the first and second embodiments, a method of preventing the developer G2 from entering the gap space X3 corresponding to the upper side of the fixing portion 16*d* will be described.

As illustrated in FIG. 22, the developer containing unit 325 includes ribs 351*b*1 and 351*b*2 and an end protrusion 351*c* configured to bring a portion of the flexible container 16 into abutment against a portion of the frames 17 and 18. The ribs 351*b*1 and 351*b*2 as "frame-side protrusion" which are "abutment portions" are provided on the portion of the frames 17 and 18, extended along the longitudinal direction, and protruded from the frames 17 and 18 toward the flexible container 16. The end protrusion 351*c* as a "container-side protrusion" which is an "abutment portion" is provided on the portion of the flexible container 16, extended along the longitudinal direction, and protruded from the flexible container 16 toward the frames 17 and 18. Specifically, the configuration is as follows.

The multi-staged ribs 351*b*1 and 351*b*2 which extend from the frame 17 to the flexible container 16 and extend in the longitudinal direction are provided to cover the entering port of the gap between the frame 17 and the flexible container 16 on the rear surface of the frame 17, as described above with reference to FIG. 21. In this example, the configuration is such that the rib 351*b* is provided in a plurality of stages in a direction perpendicular to the longitudinal direction. However, the configuration is not limited to this. That is, only the end protrusion 351*c* or also the end protrusion 351*c* may be provided in a plurality of stages in the direction perpendicular to the longitudinal direction.

Although the multi-staged ribs 351*b*1 and 351*b*2 are configured to be brought into abutment against the flexible container 16, depending on the deformation of the flexible container 16, all the ribs 351*b*1 and 351*b*2 are brought into abutment against the flexible container 16 or a part of the ribs 351*b*1 and 351*b*2 is brought into abutment against the flexible container 16. In FIG. 22, the upper rib 351*b*1 among the plurality of ribs is brought into abutment against the flexible container 16, and the lower rib 351*b*2 among the plurality of ribs is not brought into abutment against the flexible container 16. However, in a state in which the opening portions 35*a* are still not unsealed by the rotating member 20, all the plurality of ribs 351*b*1 and 351*b*2 are brought into abutment against the flexible container 16, although not shown in the embodiment.

Further, the end protrusion 351*c* corresponding to a "protrusion" which extends toward the rear surface of the frame 17 and extends in the longitudinal direction is provided on the end of the surface of the flexible container 16 so as to cover the entering port of the gap between the frame 17 and the flexible container 16. The end protrusion 351*c* is brought into abutment against the rear surface of the frame 17. In FIG. 22, the end protrusion 351*c* is arranged to be inserted between the upper rib 351*b*1 and the lower rib 351*b*2. With this configuration, the developer G2 can be further prevented from entering the gap between the frame 17 and the flexible container 16 from the lower side space X2.

As illustrated in FIG. 22, the ribs 351*b*1 and 351*b*2 and the end protrusion 351*c* are arranged at a portion where the developer starts to enter the gap between the frame 17 and the flexible container 16 from the lower side space X2 due to a pressure in the direction indicated by the arrows J in the upper side space X1 generated by the conveying action of the pressure sheet 21. By configuring so that the ribs 351*b*1 and 351*b*2 are brought into abutment without a gap against both the frame 17 and the flexible container 16 along the longitudinal direction of the frame 17, the developer can be prevented from entering the gap. This enables a reduction of the developer that enters through the back of the frame, and hence the developer used in the image formation can be increased so that the developer can be used without waste.

Figure 26:
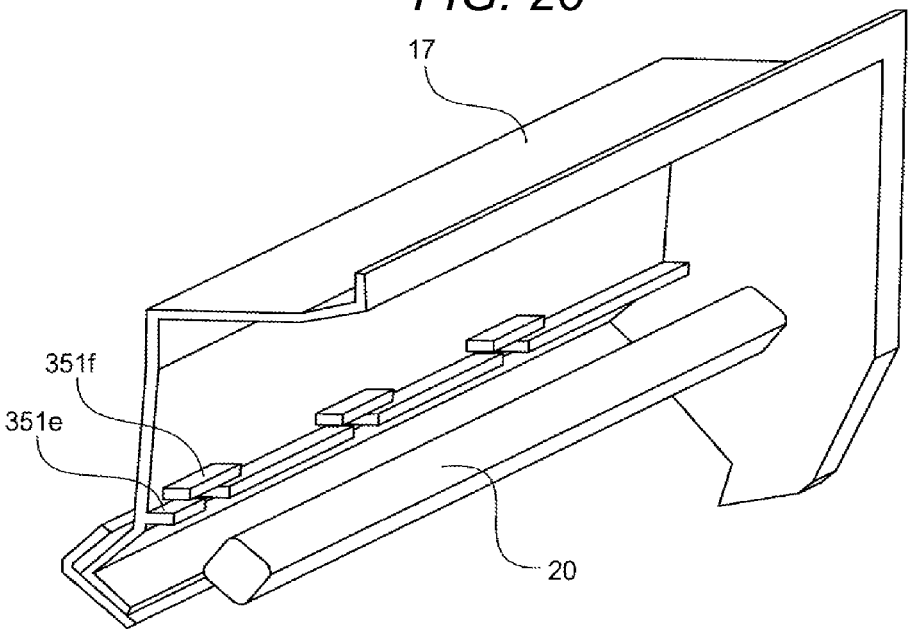
FIG. 26 is a perspective view illustrating another configuration of the frame.

In the embodiment, the ribs 351*b*1 and 351*b*2 are formed over the entire length in the longitudinal direction of the frame 17. However, the configuration is not limited to this. That is, as illustrated in FIG. 26, ribs 351*f* and 351*e* can be configured as a combination of a plurality of ribs divided in the longitudinal direction, rather them a rib of a continuous ridge. In this manner, even with the divided configuration, a gap between the ribs can be covered because the flexible container 16 has the flexibility.

Figure 27:
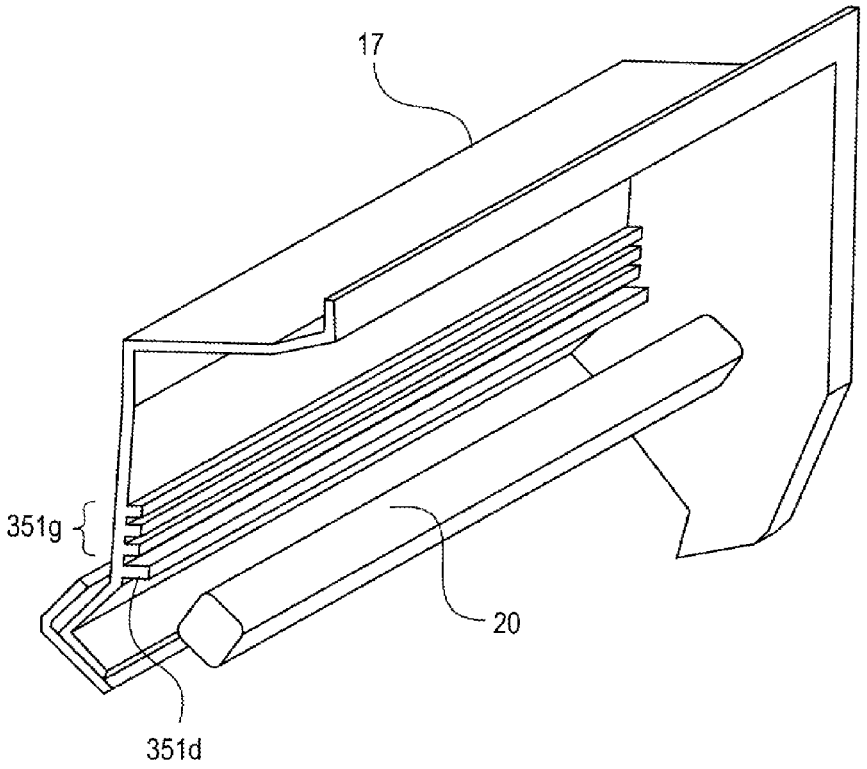
FIG. 27 is a perspective view illustrating still another configuration of the frame.

Further, as illustrated in FIG. 27, a plurality of ribs 351*g* can be provided in the form of a plurality of stages in the short direction perpendicular to the longitudinal direction. In this case, the flexible container 16 and the ribs 351*g* can prevent the entering of the developer G2 at a plurality of places.

In the embodiment, the ribs 351*b*1 and 351*b*2 of the frames 17 and 18 are extended along the longitudinal direction. However, the ribs 351*b*1 and 351*b*2 are not necessarily to be formed in a straight line shape, and, for example, an arc shape can also be used as long as an abutment relationship conforming to the stereoscopic shape of the flexible container 16 can be achieved. Regarding the end protrusion 351*c* of a lip shape of the flexible container 16 as well, the end protrusion 351*c* is not necessarily to be formed in a straight line shape, but, for example, a protrusion obtained by a mountain fold can also be used other than the end protrusion 351*c* which constitutes the flexible container 16 as long as the abutment relationship can be achieved.

Further, from the technical idea of the third embodiment, in the developer containing unit 25 according to the first embodiment, the abutment portion 51*a* can be configured to be provided in the form of a plurality of stages in the direction perpendicular to the longitudinal direction.

Fourth Embodiment

Figure 23:
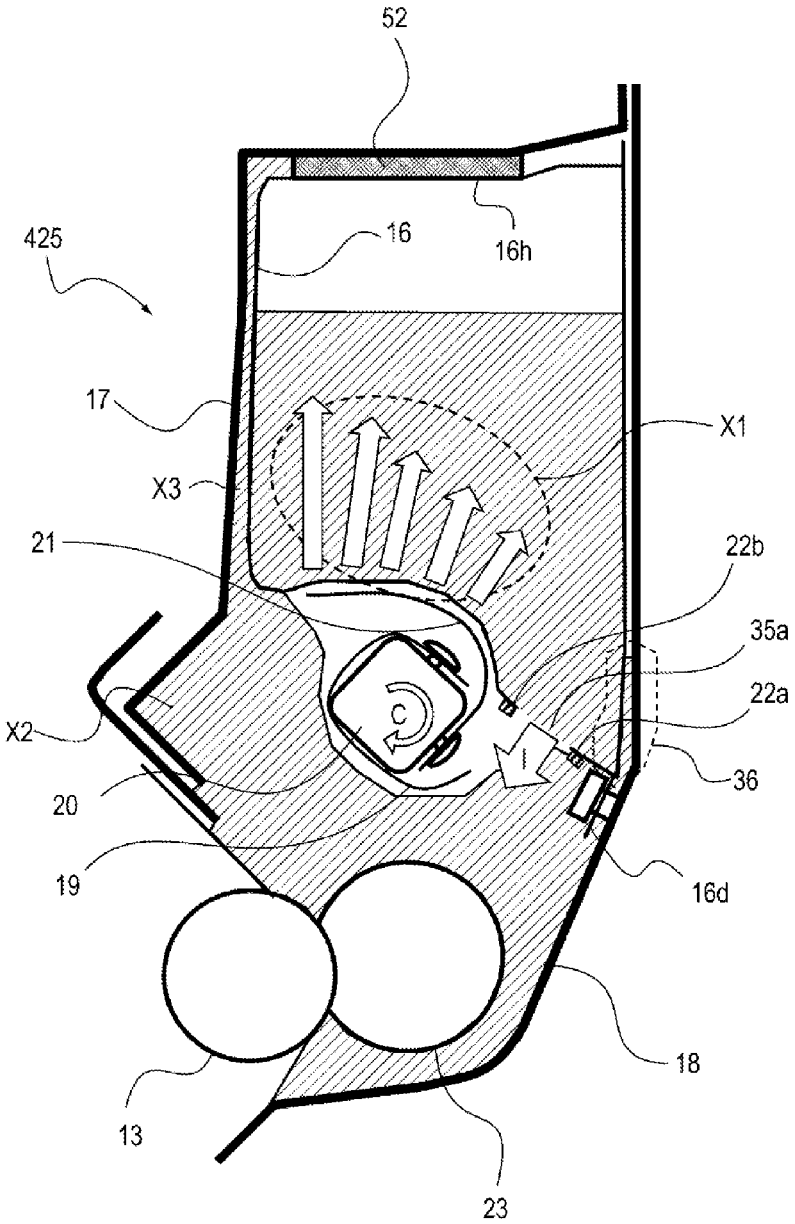
FIG. 23 is a cross-sectional view illustrating a configuration of a developer containing unit according to a fourth embodiment of the present invention.

FIG. 23 is a cross-sectional view illustrating a configuration of a developer containing unit 425. In the same manner as the first to third embodiments, a method of preventing the developer G2 from entering the gap space X3 corresponding to the upper side of the fixing portion 16*d* will be described. The following is performed to bring the flexible container 16 and the frames 17 and 18, which face each other into abutment against each other in a region of the frames 17 and 18 where the flexible container 16 is located. That is, a portion having a slope smaller than a repose angle of the developer G2 in the flexible container 16 or the saddle portion 16*h* which is a recessed portion recessed downwardly in the flexible container 16 is brought into contact with a portion of the frames 17 and 18. To this end, an abutment portion 52 is provided, which has viscosity or adhesiveness with respect to a portion of the frames 17 and 18 along the longitudinal direction and viscosity or adhesiveness with respect to a portion of the flexible container 16 along the longitudinal direction.

A specific description will be provided in the following. As described above with reference to FIG. 19, the developer G2 may be kicked up in the direction indicated by the arrow M due to a pressure in the direction indicated by the arrows J in the upper side space X1 generated by the conveying action of the pressure sheet 21 and enter toward the top portion of the flexible container 16. Further, the saddle portion 16*h* may be formed on the flexible container 16 by the weight of the developer G2 entered in the above-mentioned.

The abutment portion 52 which is brought into abutment against both the frame 17 and the flexible container 16 is arranged between the rear surface of the top portion of the frame 17 and the surface of the top portion of the flexible container 16. The top portion of the flexible container 16 corresponds to the portion of the flexible container 16 having the slope smaller than the repose angle of the developer G2 and a portion where the developer is accumulated, such as the saddle portion 16*h* (see FIG. 19) where the flexible container 16 forms a saddle shape.

The abutment portion 52 is arranged to be brought into abutment without a gap against both the frame 17 and the flexible container 16 along the longitudinal direction of the frame 17 by using an adhesive agent, a pressure-sensitive adhesive agent, or a double-sided tape. With the abutment portion 52 arranged in the above-mentioned, the developer G2 can be prevented from entering, and thus the developer G2 which enters through the back of the frame 17 can be reduced. In this manner, the developer G2 used in the image formation can be increased so that the developer G2 can be used without waste.

Fifth Embodiment

Outline of Whereabouts of Developer after Unsealing

FIG. 18 is a perspective view illustrating a state before the opening portion 35*a* of the flexible container 16 is unsealed. The whereabouts of the developer after unsealing will he described with reference to FIG. 18. As described above, when the unsealing is completed, normally, the developer is delivered toward the developing roller 13 by the conveying action of the pressure sheet 21. At this time, the developer G2 is supplied to the developing roller 13, and at the same time, as the arrow M illustrated in FIG. 19, a pressure is generated in the direction indicated by the arrows J in the upper side space X1 toward the inside of the frame of the developer containing unit 25. This may cause a flow in a direction indicated by an arrow L around the longitudinal end portion of the flexible container 16 along the longitudinal direction inside the frame.

By the continuation of the conveying action of the pressure sheet 21, the developer may enter the space 26 which is formed by the flexible container 16 and the frame 18, which is on a rear side across the flexible container 16 with respect to the space for conveying the developer to the developing roller 13. In a state in which the cartridge A is mounted on the image forming apparatus 100. there is no path for discharging the developer from the space 26, and hence this developer cannot be used in the image formation.

Outline of Measure to Prevent Entering of Developer

Figure 24:
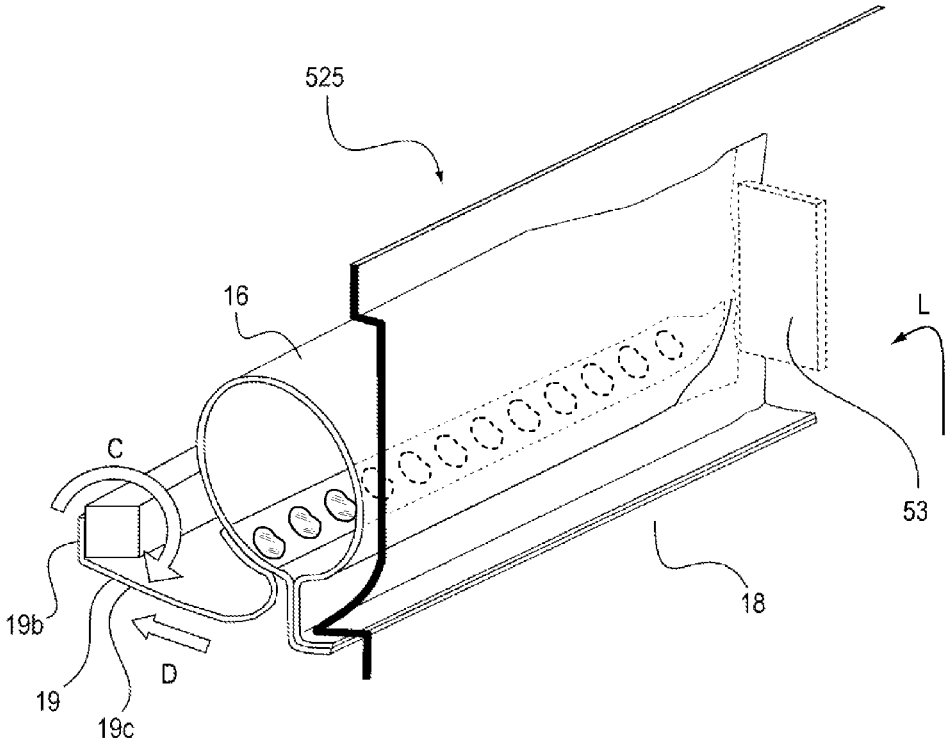
FIG. 24 is a cross-sectional view illustrating a configuration of a developer containing unit according to a fifth embodiment of the present invention.

FIG. 24 is a perspective view illustrating a configuration of a developer containing unit 525 according to the fifth embodiment. In particular, FIG. 24 is a perspective view from the cross section of the developer containing unit 25 at a position corresponding to the end portion of the flexible container 16. A method of preventing the developer from entering from the direction indicated by the arrow L at the longitudinal end portion of the flexible container 16 will be described with reference to FIG. 24. A rib 53 which is an "abutment portion" is arranged between the flexible container 16 and the frame 18 so as to extend in the direction perpendicular to the longitudinal direction on the end portion side of the flexible container 16. A specific description will be provided in the following.

As described above, the rib 53 is provided along the short direction of the frame 18 and is brought into abutment against the flexible container 16 at a portion where the entering of the developer is started into the space 26 from the direction indicated by the arrow L at the longitudinal end portion of the flexible container 16. A similar rib is brought into abutment against the flexible container 16 also from the frame 17. With this configuration, the rib is configured to be brought into abutment without a gap against both sides of the flexible container 16. The developer then can be prevented from entering the space 26, and by reducing the developer that enters through the back of the frame, the developer G2 used in the image formation can be increased so that the developer can be used without waste.

Sixth Embodiment

Another configuration example of the above-mentioned support member will be described below. In the second and third embodiments, the examples in which the support member is arranged across the entire surface in the longitudinal direction are described. However, a sixth embodiment describes an example in which the support member is not extended across the entire surface in the longitudinal direction.

Figure 33:
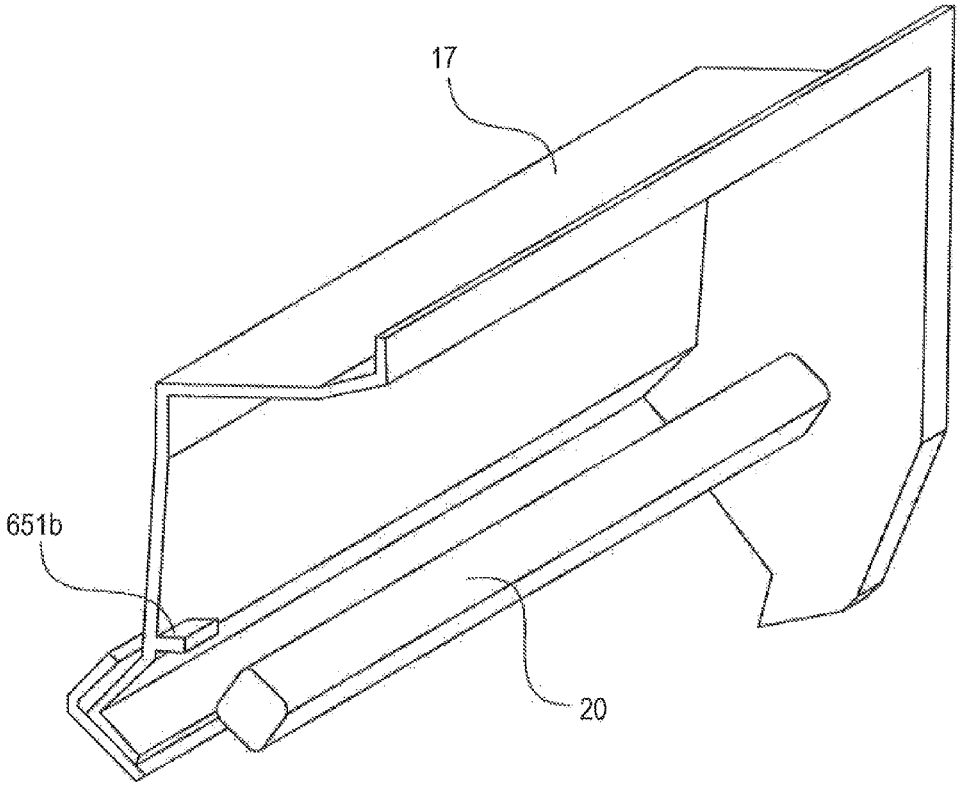
FIG. 33 is a perspective view illustrating another configuration of the frame.

Firstly, an example in which the support member is arranged in proximity to the flexible container 16 only at both end portions in the longitudinal direction will be described. As illustrated in FIGS. 21 and 33, a support member 651*b* is arranged in proximity to the flexible container 16 only by a predetermined length at the both end portions in the longitudinal direction with respect to the center portion.

As described in "Effect of Support Member" in the second embodiment, when the developer containing unit 25 is stored in a standing state in such an attitude that the rotation axis of the developing roller 13 is parallel to the direction of the gravity, it is likely to be hard to discharge the developer G from the opening portion 35*a* particularly at the both end portions on the upper side and the lower side in the vertical direction. Therefore, even with an arrangement of the support member only at the both end portions in the longitudinal direction where the deficiency of the discharge of the developer due to the lopsidedness of the flexible container 16 in the longitudinal direction is conspicuous, the effect of suppressing the lopsidedness can be obtained in the same manner as in the second and third embodiments.

Figure 34:
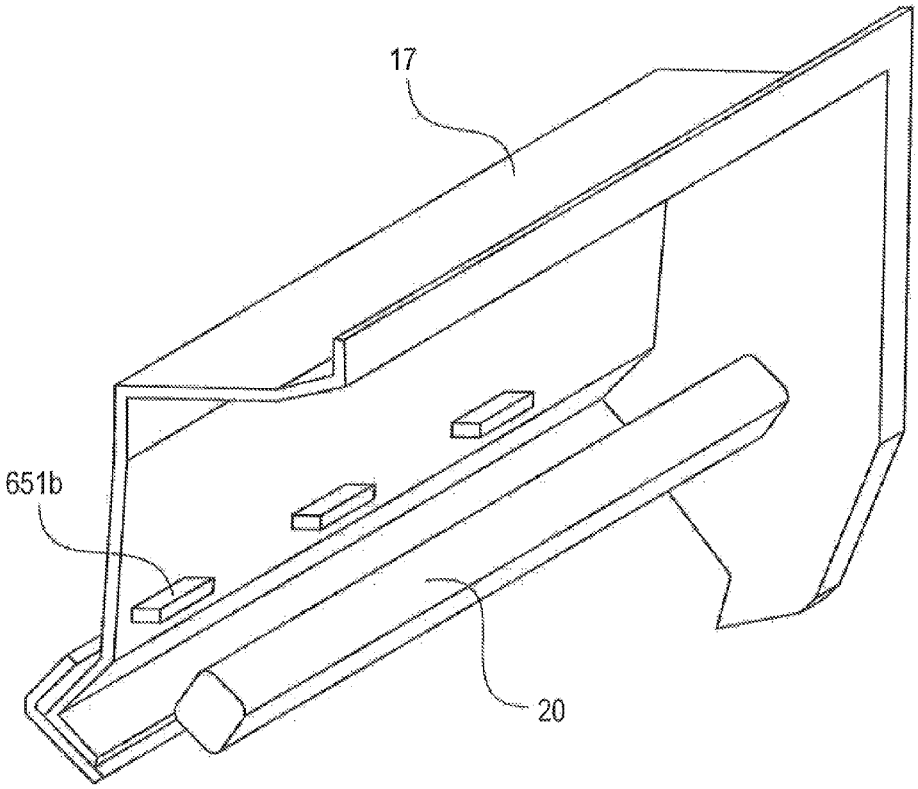
FIG. 34 is a perspective view illustrating another configuration of the frame.

As another example, a case where the rib 251*b* (abutment portion) illustrated in FIG. 21 has gaps in the longitudinal direction will be described. As illustrated in FIG. 34, on a cross section perpendicular to the rotation axis of the developing roller 13, the support member 651*b* extends from the frame 17 toward the proximity to the flexible container 16. The support member 651*b* has gaps in the longitudinal direction, and hence it is expected to have an effect of reducing the developer which is accumulated above the support member 651*b* in the vertical direction. Further, the support member 651*b* can be a separate member, rather than a part of the frame 17. For example, the support member 651*b* may be bonded to the frame 17 or fitted into the frame 17, as a separate member.

Case Where End Portion in Longitudinal Direction is not Supported

Even without an arrangement of the support member at the end portion in the longitudinal direction, the effect of suppressing the lopsidedness of the flexible container 16 in the longitudinal direction can be obtained.

Support Position in Longitudinal Direction

Figure 35A:
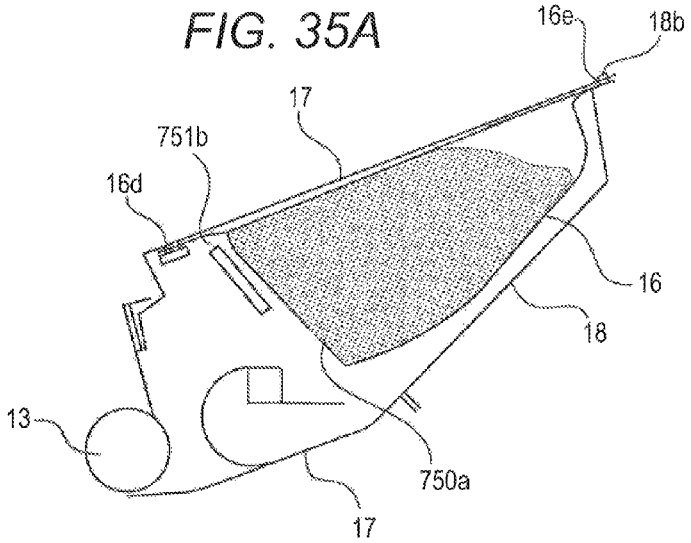
FIGS. 35A, 35B, 35C, and 35D are cross-sectional views illustrating a configuration of a developer containing unit according to a seventh embodiment.

In the state in which the developer containing unit 25 is stored in a standing state in such an attitude that the rotation axis of the developing roller 13 is parallel to the direction of the gravity, one of the end portions is located on the lower side in the vertical direction so that the flexible container 16 may be inflated and deformed. When the support member is arranged only on one side in the longitudinal direction as viewed from the center, the effect of the support member is likely to be small. Therefore, it is preferred that the support member be arranged on both sides of the flexible container 16 in the longitudinal direction with respect to the center, Seventh Embodiment FIGS. 35A, 35B, 35C, and 35D illustrate an example of a developer containing unit having a configuration in which the flexible container 16 is suspended by two points of fixing portions 16*d* and 16*e*. FIG. 35A is a cross-sectional view perpendicular to the rotation axis of the developing roller 13. FIGS, 35B, 35C, and 35D are entire longitudinal image diagrams of the flexible container 16 and a support member 751*b* as viewed from the developing roller 13.

Figure 35B:
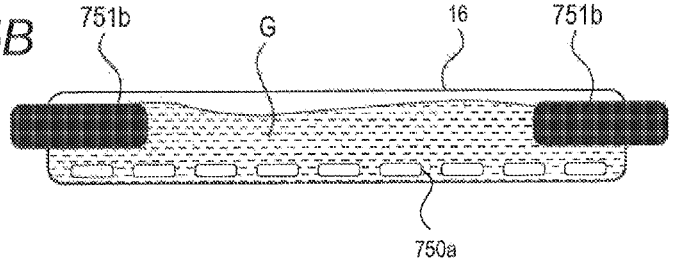
Figure 35C:
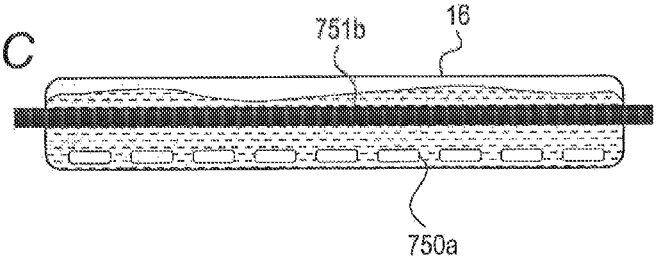
Figure 35D:
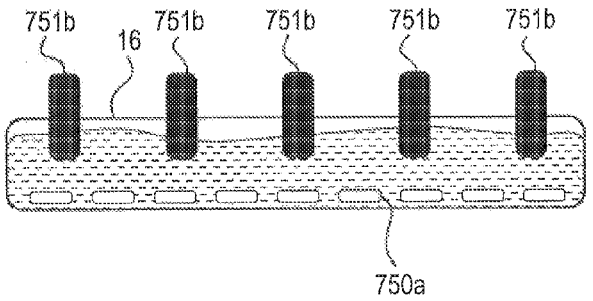

As with the configuration described in the second, third, and sixth embodiments, for example, the support members 751*b* is arranged only at each of the end portions in the longitudinal direction in FIG. 35B, extended across the entire longitudinal direction in FIG. 35C, or has gaps in the longitudinal direction in FIG. 35D. By arranging the support member 751*b* in this manner, the lopsidedness of the flexible container 16 in the longitudinal direction can be suppressed, There are opening portions 750*a*.

Eighth Embodiment

Figures 31A, 31B, 31C, 31D:
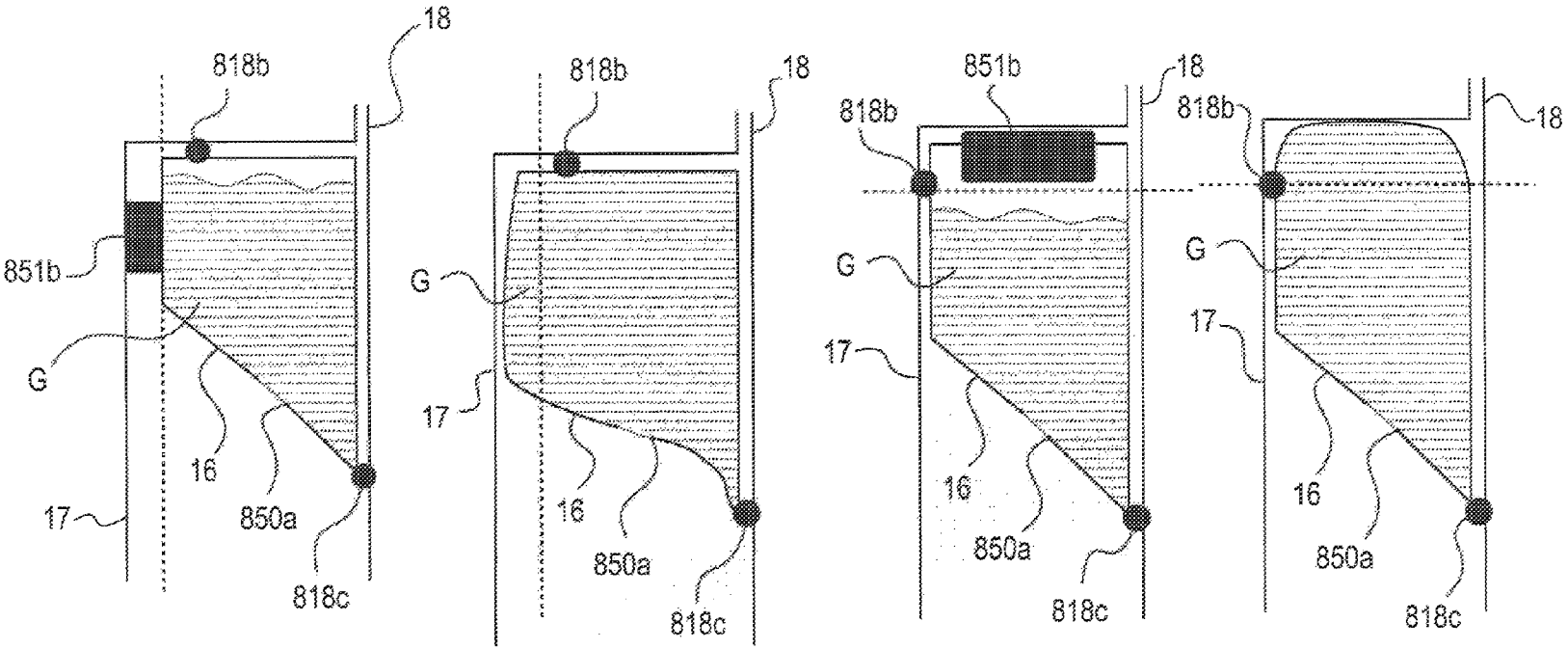
FIGS. 31A, 31B, 31C, and 31D are cross-sectional views for illustrating an arrangement of a support member according to an eighth embodiment.

FIGS. 31A, 31B, 31C, and 31D are cross-sectional views of the developer containing unit, for illustrating modification examples for suppressing the inflation of the flexible container 16 in the horizontal direction. FIG. 31A illustrates an embodiment in which a support member 851*b* is arranged above an opening portion 850*a* in the vertical direction and on a side in the horizontal direction of the flexible container 16. In the embodiment, the deformation of the flexible container 16 is suppressed. However, in FIG. 31B that illustrates a comparative example in which the support member 851*b* is not arranged, the flexible container 16 is deformed in the horizontal direction, and the powder pressure of the developer against the opening portion 850*a* is eventually increased so that it is hard to discharge the developer from the flexible container 16 due to the advance of the packing state.

The same goes for the above in the vertical direction, as described below. FIG. 31C illustrates an embodiment in which the support member 851*b* is arranged above the opening portion 850*a* in the vertical direction and above the flexible container 16 in the vertical direction. In the embodiment, the deformation of the flexible container 16 is suppressed. However, in FIG. 31D that illustrates a comparative example in which the support member 851*b* is not arranged, the flexible container 16 is deformed upwardly in the vertical direction, and the powder pressure of the developer against the opening portion 850*a* is eventually increased so that it is hard to discharge the developer from the flexible container 16 due to the advance of the packing state. In FIGS. 31A, 31B, 31C and 31D, a fixing portion 818*b* is provided to fix the frame 17 and the flexible container 16 arid a fixing portion 818*c* is provided to fix the frame 18 and the flexible container 16.

Ninth Embodiment

Figure 36:
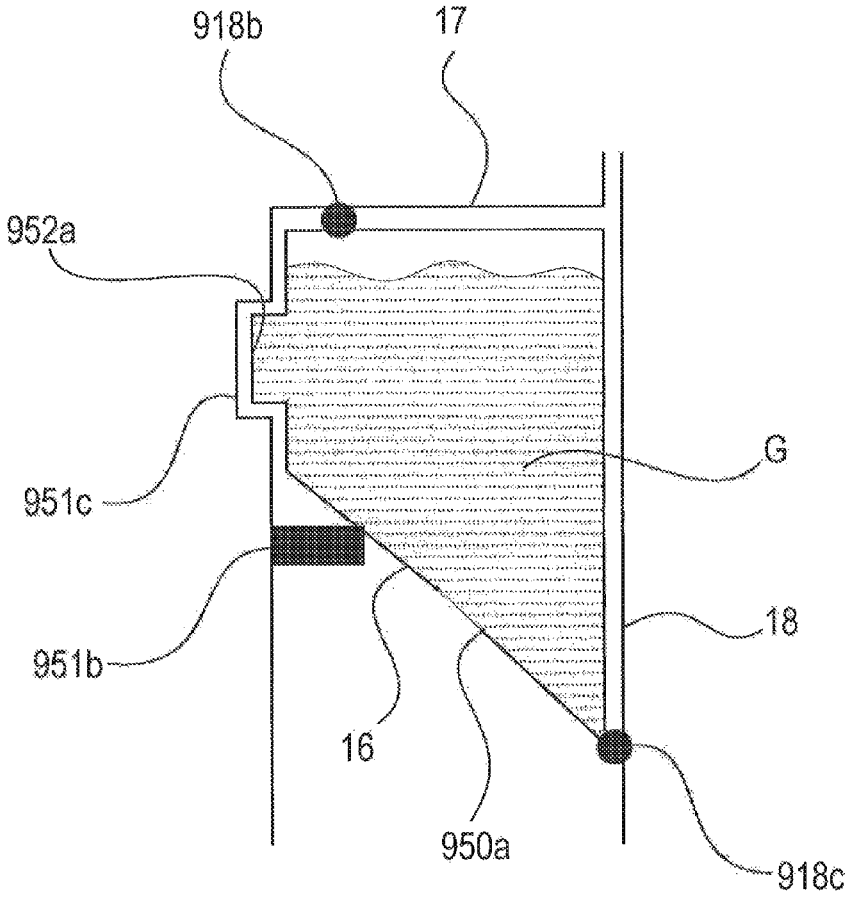
FIG. 36 a cross-sectional view illustrating a configuration of a developer containing unit according to a ninth embodiment.

FIG. 36 is a cross-sectional view of a developer containing unit according to a modification example configured to suppress the lopsidedness of the flexible container 16 in the longitudinal direction. In this example, a convex portion 952*a* is provided at a portion of the surface which defines the flexible container 16. A part of the frame 17 is provided with a support member 951*c* of a complementary shape to the convex portion 952*a* so that the support member 951*c* easily supports the convex portion 952*a*, and hence the lopsidedness of the flexible container 16 in the longitudinal direction can be further suppressed. In FIG. 36, a fixing portion 918*b* is provided to fix the frame 17 and the flexible container 16 and a fixing portion 918*c* is provided to fix the frame 18 and the flexible container 16.

Tenth Embodiment

Even in a configuration in which the pressure sheet 21 is not arranged and the sealing member 19 is separated by peeling the sealing member 19 by a user or a wrapping mechanism (not shown) in the longer direction of the opening portion, i.e., in the direction parallel to the rotation axis of the developing roller, by arranging the support member in the same manner as in the second, third, sixth, seventh, eighth, and ninth embodiments, the deformation of the flexible container 16 can be prevented, which is effective in suppressing the uneven density on the output image.

According to the present invention, a phenomenon that the developer discharged from the opening portion of the flexible container and accommodated in the frame enters the gap between the flexible container and the frame can be suppressed, and as a result, the developer can be used in the image formation without waste.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No, 2012-135580, filed Jun. 15, 2012 and Japanese Patent Application No. 2012-199740, filed Sep. 11, 2012, which are hereby incorporated by reference herein in their entirety.

What is claimed is:

1. A developer containing unit configured to contain a developer, the developer containing unit comprising:

a flexible container configured to contain the developer and provided with an opening through which the developer is discharged;

a frame configured to accommodate the flexible container;

a pressure member provided in the frame and configured to deform the flexible container; and an abutment portion extending in a longitudinal direction of the frame and at which the flexible container and the frame abut against each other.

2. A developer containing unit according to claim 1, wherein the abutment portion includes a member having viscosity or adhesiveness.

3. A developer containing unit according to claim 2, wherein the abutment portion is provided in a form of a plurality of stages in a direction perpendicular to the longitudinal direction.

4. A developer containing unit according to claim 1, wherein the abutment portion includes a frame-side protrusion which protrudes from the frame toward the flexible container.

5. A developer containing unit according to claim 4, wherein the frame-side protrusion is provided in a form of a plurality of stages in a direction perpendicular to the longitudinal direction.

6. A developer containing unit according to claim 1, wherein the abutment portion includes a container-side protrusion which protrudes from the flexible container toward the frame.

7. A developer containing unit according to claim 6, wherein the container-side protrusion is provided in a form of a plurality of stages in a direction perpendicular to the longitudinal direction.

8. A developer containing unit according to claim 1, wherein, in a state in which the developer containing unit is mounted in an image forming apparatus, the abutment portion is located on a portion of the flexible container of which a slope is smaller than a repose angle of the developer or on a recessed portion of the flexible container which is dented in a downward direction.

9. A developer containing unit according to claim 1, wherein the abutment portion is disposed on a side of an end portion of the flexible container and extended between the flexible container and the frame in a direction perpendicular to the longitudinal direction.

10. A process cartridge which is removably mountable to an image forming apparatus main body, the process cartridge comprising:

an electrophotographic photosensitive drum; and a developer containing unit as recited in claim 1, the electrophotographic photosensitive drum and the developer containing unit being integrally incorporated into the process cartridge.

11. An electrophotographic image forming apparatus, comprising an image forming apparatus main body in which a process cartridge as recited in claim 10 is mounted.

12. An electrophotographic image forming apparatus, comprising:

an electrophotographic photosensitive drum;

a developer containing unit as recited in claim 1; and a controller configured to control the pressure member, wherein the controller causes the pressure member to rotate to press the flexible container repeatedly.

13. A developer containing unit, comprising:

a flexible container configured to contain developer and provided with an opening through which the developer is discharged;

a frame configured to accommodate the flexible container;

a fixing portion configured to hold the flexible container in the frame; and an abutment portion provided in a position in which the abutment portion abuts or is allowed to abut against the flexible container, wherein the opening opens vertically downwardly, and the abutment portion is disposed vertically above the opening.

14. A developer containing unit according to claim 13, wherein in an image formable state, the abutment portion is provided in a position in which the abutment portion supports or is allowed to support a surface of the flexible container which receives a gravitational force component of the developer in a direction of gravity.

15. A developer containing unit according to claim 13, further comprising a pressure member provided in the frame in a rotatable manner and configured to be rotated to press and deform the flexible container.

16. A developer containing unit according to claim 15, wherein the abutment portion exists on each of both sides of the flexible container with respect to a center in a direction parallel to a rotation axis of the pressure member.

17. A developer containing unit according to claim 15, wherein a part of the pressure member closes the opening before a time of image formation, and the part of the pressure member opens the opening at the time of image formation.

18. A process cartridge which is removably mountable to an image forming apparatus main body, the process cartridge comprising:

an electrophotographic photosensitive drum; and a developer containing unit as recited in claim 13, the electrophotographic photosensitive drum and the developer containing unit being integrally incorporated into the process cartridge.

19. An electrophotographic image forming apparatus, comprising an image forming apparatus main body in which a process cartridge as recited in claim 18 is mounted.

20. An electrophotographic image forming apparatus, comprising:

an electrophotographic photosensitive drum;

per containing unit as recited in claim 15; and a controller configured to control the pressure member, wherein the controller causes the pressure member to rotate to press the flexible container repeatedly.

21. A developer containing unit according to claim 1, wherein the abutment portion is arranged to prevent the developer from entering between the frame and the flexible container.

22. A developer containing unit according to claim 13, wherein the abutment portion is arranged to prevent the developer from entering between the frame and the flexible container.

* * * * *